US005139249A

United States Patent [19]

Hosoi et al.

[11] Patent Number: 5,139,249

[45] Date of Patent: Aug. 18, 1992

[54] AFTER TREATMENT DEVICE FOR SORTED PAPERS

[75] Inventors: Masatoshi Hosoi; Masashi Shimada, both of Okazaki, Japan

[73] Assignee: Ricoh Company, Ltd., Tokyo, Japan

[21] Appl. No.: 723,294

[22] Filed: Jun. 28, 1991

[30] Foreign Application Priority Data

Jun. 29, 1990 [JP] Japan ..... 2-169953
Mar. 22, 1991 [JP] Japan ..... 3-81164
Apr. 25, 1991 [JP] Japan ..... 3-121752

[51] Int. Cl.[5] ..... B42B 1/02
[52] U.S. Cl. ..... 270/53
[58] Field of Search ..... 270/37, 53, 58

[56] References Cited

U.S. PATENT DOCUMENTS 4,986,520 1/1991 Shido ..... 270/53
5,031,890 7/1991 Hosoi ..... 270/53
5,035,412 7/1991 Hiroi ..... 270/53
5,044,625 9/1991 Reid ..... 271/293

FOREIGN PATENT DOCUMENTS 147295 6/1990 Japan ..... 270/53

*Primary Examiner*—Edward K. Look
*Assistant Examiner*—Therese M. Newholm
*Attorney, Agent, or Firm*—Oblon, Spivak, McClelland, Maier & Neustadt

[57] ABSTRACT

An after treatment device for sorted papers comprising: a sorting unit for conducting a sorting operation, the unit comprising a plurality of bins onto which papers are distributed one after another to be sorted; a paper arrangement unit for evenly arranging edges of said papers delivered on each of the bins; an after treatment unit for applying after treatment to the papers evenly arranged on each of the bins; and a control unit for controlling the device. The device is controlled in such a way that the operating time for the after treatment in a state where the after treatment is conducted simultaneously with the sorting operation is different from the operating time for the after treatment in a state where the after treatment is conducted after the sorting operation is ended.

15 Claims, 34 Drawing Sheets (WITHOUT DUMMY TIME OF 120ms)

AFTER TREATMENT DEVICE FOR SORTED PAPERS

BACKGROUND OF THE INVENTION

1. Field of the Invention

The present invention relates to an after treatment device for sorted papers installed in a copying machine and a printer, etc.

2. Description of the Related Art

In an copying apparatus or a printer, a copying paper on which an original image is copied or a printed paper or sheet is guided to one of bins of a sorter or a stack of the apparatus or the printer. When a predetermined number of papers are stacked on each bin, the stack of papers is taken out of the bin for conducting an after treatment such as binding the papers by a stapler or a fastener, forming binding holes by a punching device, or applying paste for bookbinding. Such an after treatment is conducted by an operator handling the stacks of papers taking out of bins, which is inefficient and troublesome. Therefore, an after treatment device has been developed which carries out a predetermined treatment for the papers in the bin. For example, there is a sorter stapling device which staples the stack of papers in each bin.

A typical example of such an after treatment device for sorted papers (sorter stapler) is disclosed in Japanese Patent Application Laying Open (KOKAI) Nos. 62-290655, 62-290677, 63-60871, and 63-116168, wherein when a predetermined number of papers are discharged into respective bins, the papers in each bin are stapled.

In that case, it is necessary to evenly arrange the edges of the papers, copying papers for instance, stacked in the bin so as to reliably bind the papers. For this purpose, the copying apparatus comprises a means for arranging the paper edges even in each bin. In order to enhance the productivity, the stapling operation may be started when a last original is copied and the copy paper is discharged into a first bin, without waiting till a predetermined number of papers are stacked in all of the bins.

The copying apparatus equipped with the sorter stapler is selectively operated in an autostaple mode or a manual staple mode set as a binding mode. In the auto staple mode, in conjunction with an ADF (Auto Document Feeder), the stapling operation is automatically started after the last original is copied so that the copy papers are bound. On the other hand, in the manual staple mode, in conjunction with a SADF (Semi Auto Document Feeder), the stapling operation is started by manipulating a staple key after the papers are sorted.

In accordance with the above-mentioned patent documents, the stapling operation is started after all bins are filled with a predetermined number of papers, that is, the stapling operation is not started even if one of the bins is filled with the predetermined number of papers until the remaining bins are filled with the papers, which is very inefficient.

Also, it is possible, as mentioned before, to start the stapling operation when the copy of the last original is discharged in the first bin so that the papers are bound from the first bin. However, in this case, since the stapling operation is controlled independently from the paper arranging operation, if the operation time is shortened as possible in the stapling sequence, the time for functioning the jogger becomes too short for conducting a sufficient jogging motion, which generates a time for "wait" and the motion becomes unsmooth in addition to that the productivity is lowered.

SUMMARY OF THE INVENTION

The present invention was made considering the above-mentioned problems of the related art. It is therefore an object of the present invention to provide an after treatment device for sorted papers wherein the unsmooth motion due to the generation of the waiting time is avoided and the jogger is fully operated so that the paper edges are reliably arranged even, which increases the productivity in spite of that the time for stapling sequence is elongated.

The above-mentioned object of the present invention can be achieved by an after treatment device for sorted papers comprising:

a sorting unit for conducting a sorting operation, the unit comprising a plurality of bins onto which papers are distributed one after another to be sorted;

a paper arrangement unit for evenly arranging edges of the papers delivered on each of the bins;

an after treatment unit for applying after treatment to the papers evenly arranged on each of the bins; and a control unit for controlling the device in such a way that the operating time for the after treatment in a state where the after treatment is conducted simultaneously with the sorting operation is different from the operating time for the after treatment in a state where the after treatment is conducted after the sorting operation is ended.

In accordance with the above-mentioned structure of the after treatment device, a dummy time is inserted in the auto stapling operation where the sorting function and the stapling function are simultaneously conducted, which makes it possible to raise the productivity required by users in spite of that the time for one stapling function is elongated and avoid the unsmooth motion due to the waiting time.

An advantage of the after treatment device according to the present invention is that it becomes possible to smoothly function the device in the stapling operation without generating the waiting time deleting the irregular sound of the device, which makes the user free from being uncomfortable when using the device.

Another advantage of the present invention is that the jogger functions many times in the stapling operation, which increases the reliability of arranging the paper edges even as a result of which it becomes possible to enhance the productivity satisfying a high CPM (Copy Per Minute) requirement.

Further objects and advantages of the present invention will be apparent from the following description of the preferred embodiments of the invention as illustrated in the accompanying drawings.

DESCRIPTION OF THE PREFERRED EMBODIMENTS

Figure 1:
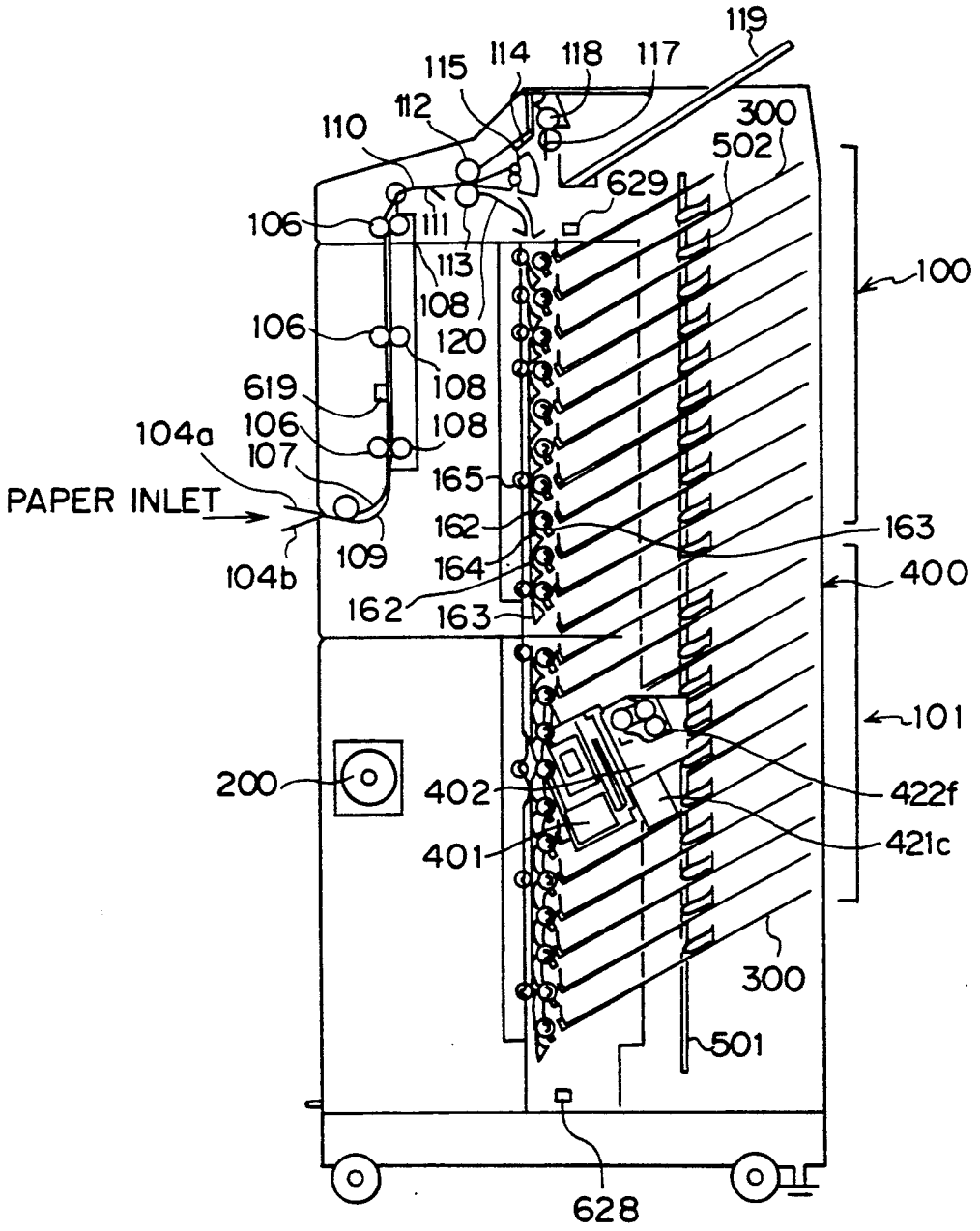
FIG. 1 is a front view of an embodiment of the present invention.

Embodiments of the present invention are described hereinafter with reference to the drawings.

First, the function of an embodiment of the present invention is described with reference to FIGS. 1 and 2.

A copy paper discharged from a copying apparatus is inserted into a sorter stapler of the present invention through a pair of inlet guides 104*a* and 104*b* and conveyed upward through guide plates 107, 109, 110 and 111 and conveyer rollers 106, 108, 112 and 113.

In a paper discharge mode wherein the copy is to be discharged onto a discharge paper tray, a switching claw 115 is positioned in a down side, so that the copy is conveyed through a guide plate 114 and discharged onto the tray 119 through a pair of paper discharging rollers 117 and 118.

On the other hand, in a sort mode wherein the copy papers are sorted in order of page of the original, and in a stack mode wherein the papers are sorted in groups of the same page, the claw 115 is positioned in an upper side so that the papers are conveyed downward through a guide plate 120. Each copy paper is conveyed through a drive roller 162 and a follower roller 165 and discharged into a bin 300 at a position where a deflection claw 164 is functioning. The claw 164 functions in response to the operation mode, that is, the sort mode or the stack mode.

In the sorting mode operation, the claw 164 of the uppermost first bin 300 functions so that the first copy of page 1 is distributed onto the first bin 300. The subsequent second copy of the same page 1 is distributed on the second bin by the function of the claw of the second bin. Also, the first copy of page 2 is distributed onto the first bin 300 and the second copy of the page 2 is distributed onto the second bin. In this way, copies every page are stacked on each bin 300 in order of page number.

On the other hand, in the stack mode operation, the claws 164 of the bins function so that all of the copies of page 1 are distributed onto the first bin and the copies of page 2 are distributed onto the second bin. In this way, copies of the same page are distributed onto the same bin so that the copies are sorted by pages.

Next, the structure for stapling the copy papers sorted as mentioned above is described below. To staple the copies, the edges of the copies have to be arranged even. For this purpose, the sorter of the present invention comprises a jogger which is described below with reference to FIGS. 3 to 6.

Figure 2:
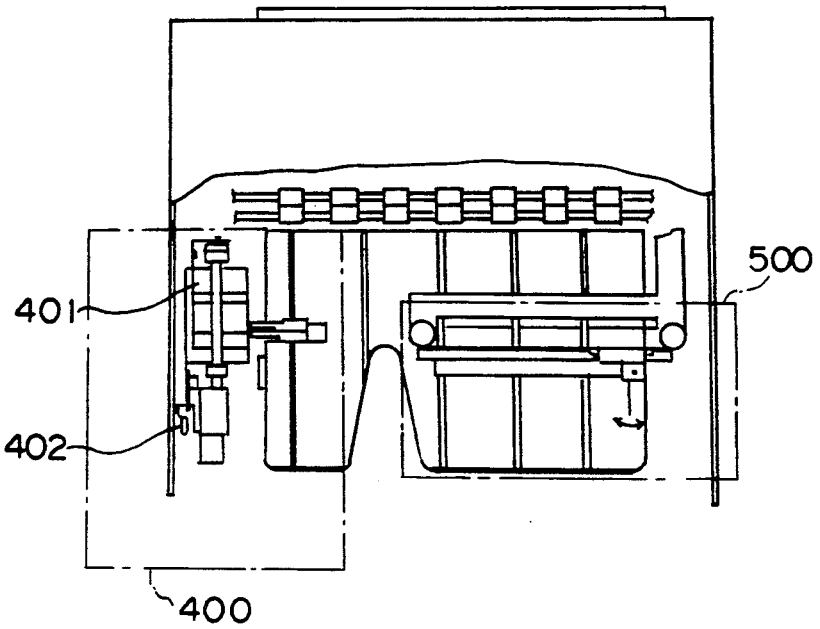
FIG. 2 is a plan view of the embodiment of the present invention.
Figure 4:
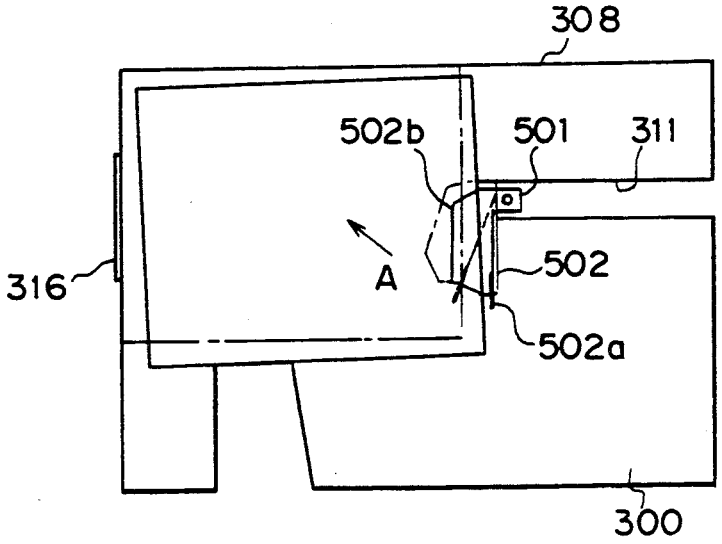
FIG. 4 is a plan view of the embodiment of the present invention representing the positional relation between the jogger and the bin.
Figure 3:
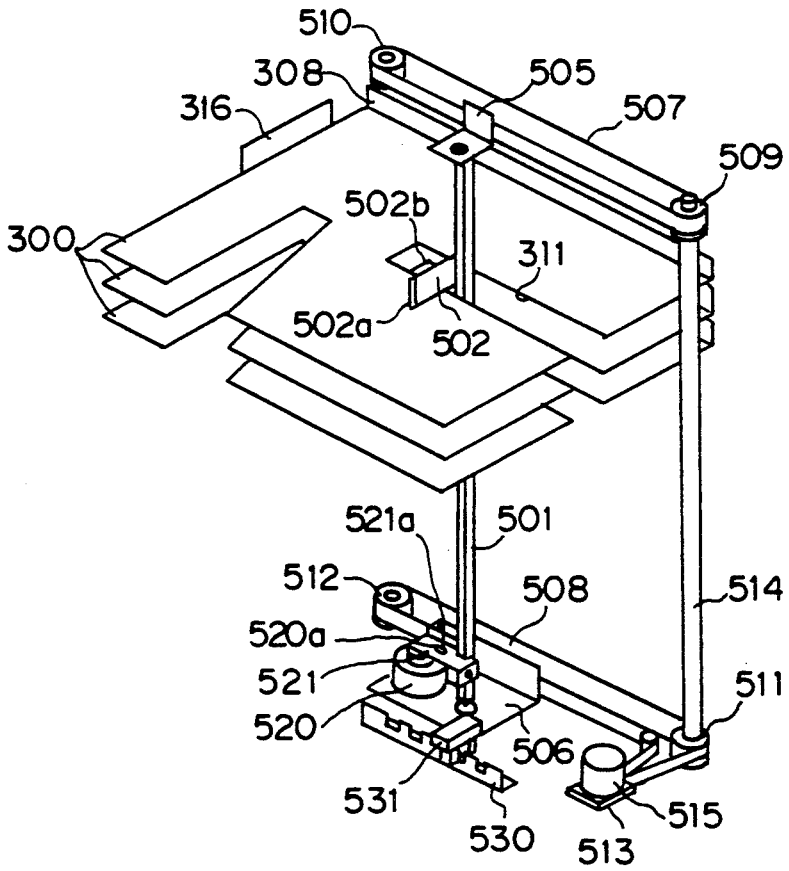
FIG. 3 is a perspective view of a jogger device in accordance with an embodiment of the present invention.

FIG. 3 illustrates the jogger installed in the sorter of FIG. 1. And FIG. 4 illustrates a plan view of the jogger and the bin 300.

On one side edge of each bin 300, a bin fence 316 is attached. A flange 308 is formed upward from the edge perpendicular to the edge of the fence 316 of each bin 300. Also, a slit 311 is formed from the other edge opposite to the fence side of the bin 300. The slit 311 has a predetermined length toward the fence 316. A main axle 501 having a polygon section is disposed penetrating vertically through the slits 311 of the bins 300. The axle 501 has pushing pieces 502 secured thereto at positions corresponding to the bins 300. Each pushing piece 502 is arranged to abut against the edges of the copies stacked on each bin for evenly arrange the copy edges.

An L-shaped bracket 505 is attached to an upper end of the axle 501 and an L-shaped bracket 506 is attached to a lower end of the axle 501. Timing belts 507 and 508 are disposed in the same direction as the slits 311 at an upper side and a lower side of the stack of bins 300. The upper and lower brackets 505 and 506 are secured to the upper and lower belts 507 and 508, respectively. The upper belt 507 is wound around pulleys 509 and 510. The lower belt 508 is wound around pulleys 511 and 512. The pulleys 509 and 511 are arranged as drive pulleys and secured to an upper and lower ends of a vertical drive rod 514, respectively. The lower belt 508 is further wound around a pulley 513 which is connected to an output shaft of a size changing motor 515.

As illustrated in FIG. 3, a size detection plate 530 is secured to the sorter. Also, a size detection sensor 531 is disposed on the lower bracket 506 as a size information detection means. The sensor 531 detects the position of the pushing piece 502 in conjunction with the detection plate 530.

Figure 6:
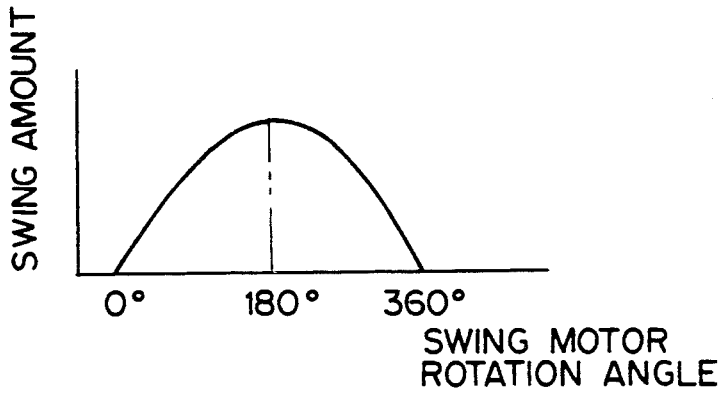
FIG. 6 is a graphical view representing the jogging amount in relation to the rotational angle of the jogging motor.
Figure 7:
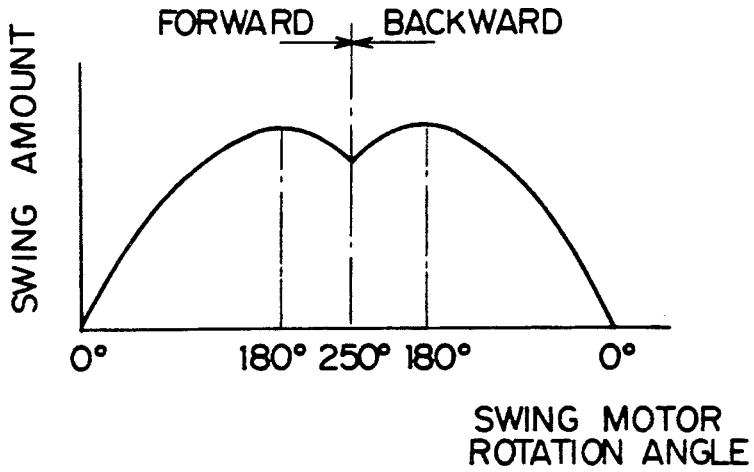
FIG. 7 is a graphical view representing the jogging amount at the time when the jogging motor is rotated forward and backward.

A jogging motor 520 is mounted on the lower bracket 506, as illustrated in FIG. 3. To the output of the motor 520 is secured an eccentric axis 520*a* which projects upward. Also, to the lower end portion of the axle 501 is attached a jogging arm 521 projecting toward the motor 520 side. The arm 521 has a slot 521*a* formed therein. The eccentric axis 520*a* is movably inserted in the slot 521*a* so that when the motor 520 is driven, the arm 521 is swung forward and backward through the eccentric axis 520*a*. The swinging force is transmitted to each pushing member 502 through the axle 501. An elastic piece 502*a* of each pushing member 502 swings between the positions of solid line and dash-dot line in FIG. 4, in a sine motion as illustrated in FIGS. 6 and 7 so that the speed of the swinging motion is lowered at around the upper dead point. The dash-dot line position of the piece 502*a* exceeds the paper edges on the bin by a predetermined length to reliably push the paper stack against the fence 316.

As mentioned above, the jogger device 500 is constituted as one unit so that the whole unit can be moved by the motor 515.

When the jogger device receives a size signal from the image forming device, the motor 515 drives the upper and lower belts 507 and 508 so that the member 502 attached to the axle 501 moves toward the side face of the stack of the copies on the bin. The jogging unit is moved to a predetermined position by the function of the sensor 531 in conjunction with the detection plate 530.

Figure 5:
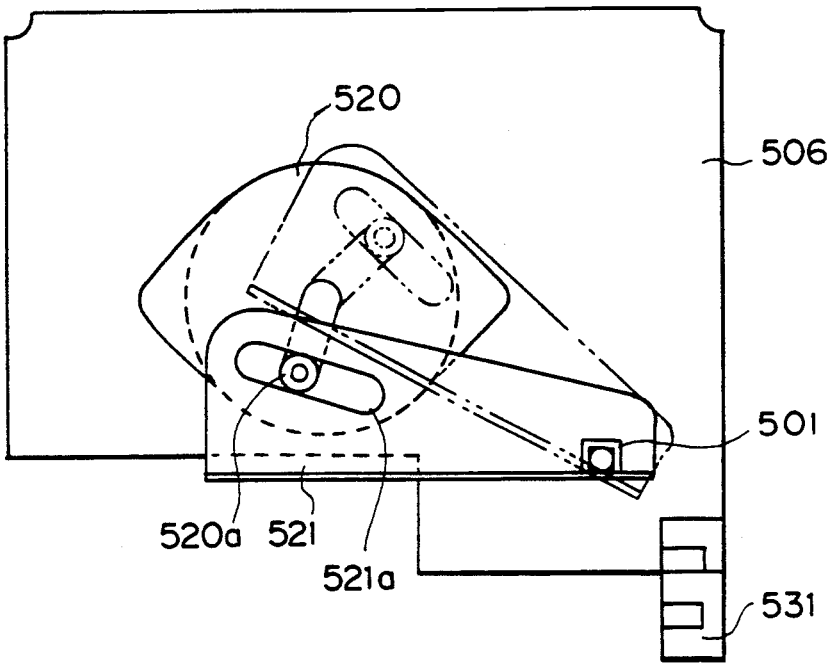
FIG. 5 is a plan view of the embodiment of the present invention representing the functioning state of the jogger.

After that, the jogging motor 520 is rotated by a half turn (180°) and then reversed to return to the home position so that the arm 521 swings by one turn. The swinging force is transmitted to each pushing member 502 through the axle 501. In such a way, the elastic piece 502*a* is moved from the solid line position to the dash-dot line in FIG. 4. Also, as illustrated in FIG. 7, the motor 520 may be rotated by more than 180° and after that reversed back to the home position so that the arm swings two turns by one stroke of the motor. Such a series of motion of the motor 520 and the member 521 is illustrated in FIG. 5.

Figure 10:
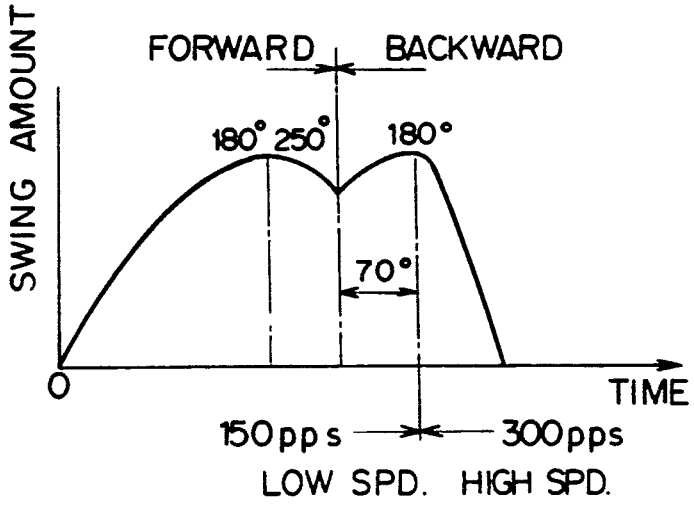
FIG. 10 is a graphical view representing the jogging amount in relation to time with respect to the variant of FIGS. 8 and 9.

FIGS. 8, 9 and 10 represent a variant of the jogger device mentioned above. In this jogger, the speed of the pushing member 502 is raised when it does not abut against the paper stack so as to shorten the jogging time, which makes it possible to be used with a high CPM copying apparatus and function to jog in the auto staple operation so that the waiting time described later is reduced. In this example, the speed of the member 502 is raised twice when not abutting against the papers, as illustrated in FIG. 10. In this case, it is not necessary to raise the motor power since the force for pushing the paper stack is not necessary.

It is to be noted that it is unnecessary to raise the speed of the jogger for the devices having a constant center basis for papers, that is, if the center basis at the time of conveying the papers is the same as that after being arranged on the jogger, since there becomes no problem if the papers are always jogged in the same manner, as is the case of display trays or finishers.

On the other hand, in the case where the papers are to be arranged on the basis of the edges thereof, that is, if the center basis at the time of conveying the papers is different from that after being arranged on the jogger, as is the case of the sorter stapler, the jogger operation is limited since the papers cannot be jogged at the time when the papers are being conveyed by the rollers. However, in this case, it becomes possible to increase the number of bins and it becomes unnecessary to change the stapler position by sizes of the papers since the papers are arranged on the basis of the stapler edge. Besides, the number of the jogging plates including the driving means thereof can be reduced to a half as in the former case.

Figure 8A:
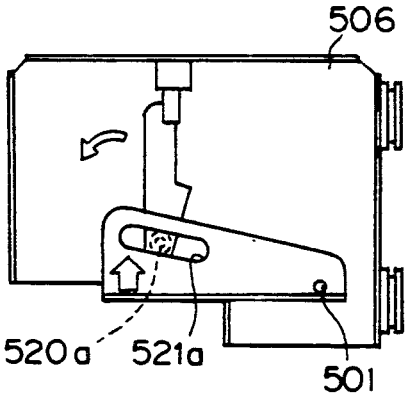
FIGS. 8*a*, 8*b* and 8*c* are explanatory views for explaining the function of a variant of the jogger in accordance with the present invention.
Figure 8B:
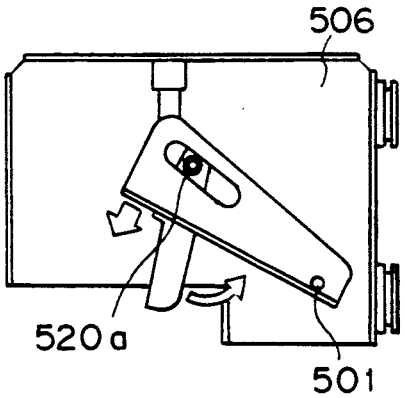
Figure 8C:
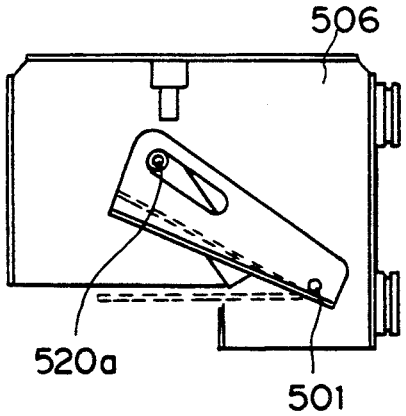
Figure 9A:
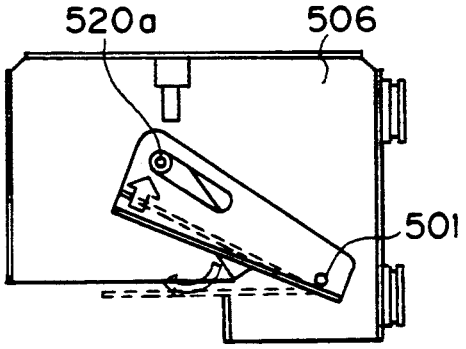
FIGS. 9*a*, 9*b* and 9*c* are explanatory views for explaining the functioning state of the jogger of FIGS. 8.
Figure 9B:
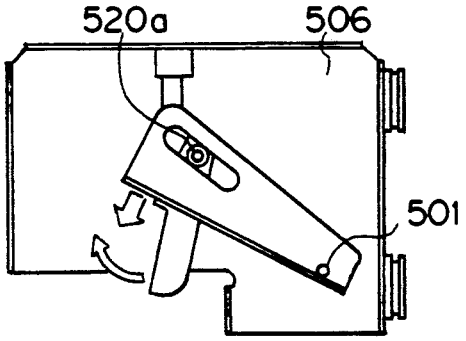
Figure 9C:
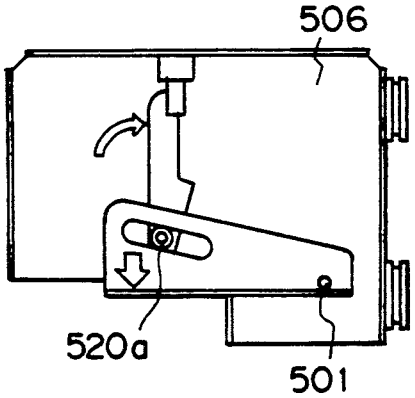

FIG. 8*a* represents a state of starting point, FIG. 8*b* represents a state of a first peak point, and FIG. 8*c* represents a state of a temporary stop point. Also, FIG. 9*a* represents a state of starting point of reverse motion, FIG. 9*b* represents a state of a second peak point, and FIG. 9*c* represents a state of returning to the home position back to the state of FIG. 8*a*. The swinging amount in relation to time is illustrated in FIG. 10.

By the swinging motion mentioned above, the elastic piece 502*a* of the pushing member 502 abuts against the side edges of the papers stacked on the bin so that the opposite side edges of the papers are pushed against the fence 316 (see FIG. 4). As a result, the edges of the papers in the side are evenly arranged. Also, the paper stack is obliquely pushed in the direction of arrow A (FIG. 4) by the pushing member 502, so that the other side of the paper perpendicular to the side abutting against the fence 316 is pushed to the flange 308 of the bin 300. As a result, the edges of the papers in the side are also arranged even.

Therefore, the edges of the paper stack are evenly arranged along the two directions.

In such a manner mentioned above, the papers distributed on each bin 300 are pushed to the edges of the bin so that the edges of the papers are evenly arranged in both directions perpendicular to each other.

However, when the CPM of the copying apparatus becomes very high, the jogging operation becomes too slow to follow the copying speed.

Therefore, the jogger means has to be shifted away from the paper route when the subsequent paper approaches and the entry sensor detects the end of the paper, in the jogging operation for the preceding papers.

Accordingly, it becomes impossible to jog the papers when the CPM is increased so high or the interval between the papers becomes so short.

To cope with such a problem, in accordance with an embodiment of the present invention, the jogger is shifted away at a timing a predetermined time later than when the paper end is detected by the entry sensor so as to increase the jogging allowable time to follow the high speed copying apparatus. The predetermined time is represented as $Lj/Vp-Tj$ in which Lj(mm) is the length from the position where the paper abuts against the jogger to the entry sensor, Vp(mm/sec) is the speed of conveying the paper, and Tj(sec) is the returning time of the jogger. In this particular embodiment, $Lj=150$ mm, $Vp=570$ mm/sec, and $Tj=110$ ms, therefore $Lj/Vp-Tj\approx150$ ms.

It is to be noted that in accordance with the above mentioned embodiment of the present invention, the speed to which the jogger system can follow is raised from 73 CPM to 80 CPM.

Figure 11:
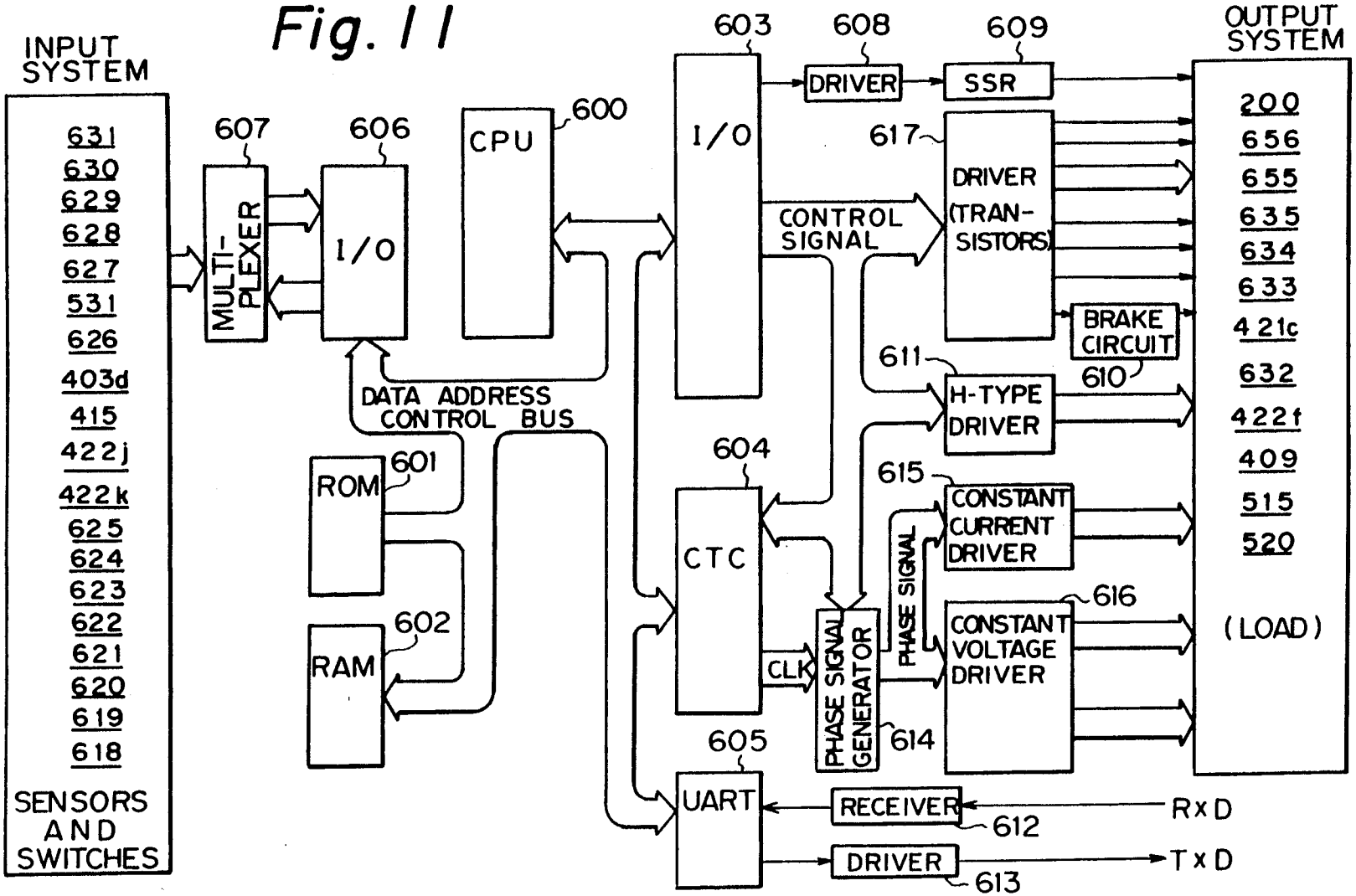
FIG. 11 is a block diagram of the control system in accordance with the present invention.

FIG. 11 illustrates a block diagram of the control system in accordance with the embodiment of the present invention. The system comprises a CPU (Central Processing Unit) 600, a ROM (Read Only Memory) 601, a RAM (Random Access Memory) 602, I/0 ports 603 and 606, a clock timer controller (CTC) 604, and a universal asynchronous receiver transmitter (UART) 605.

Input signals from an input system comprising sensors and switches are transmitted to the multiplexer 607 and I/O port 606. The input signals are transmitted to the I/O port 603 and the CTC 604 along with the program data memorized in the ROM 601 and the data of the RAM 602. The output signals from the I/O port 603 and the CTC 604 control the load as described later through drivers 608, 611, 615, 616, 617, a phase signal generator 614 and an SSR 609. Also, the system is connected to the copying apparatus so that various status information data and command signals are transmitted between the system and the copying apparatus by the UART 605 through a receiver 612 and a driver 613.

Figure 12:
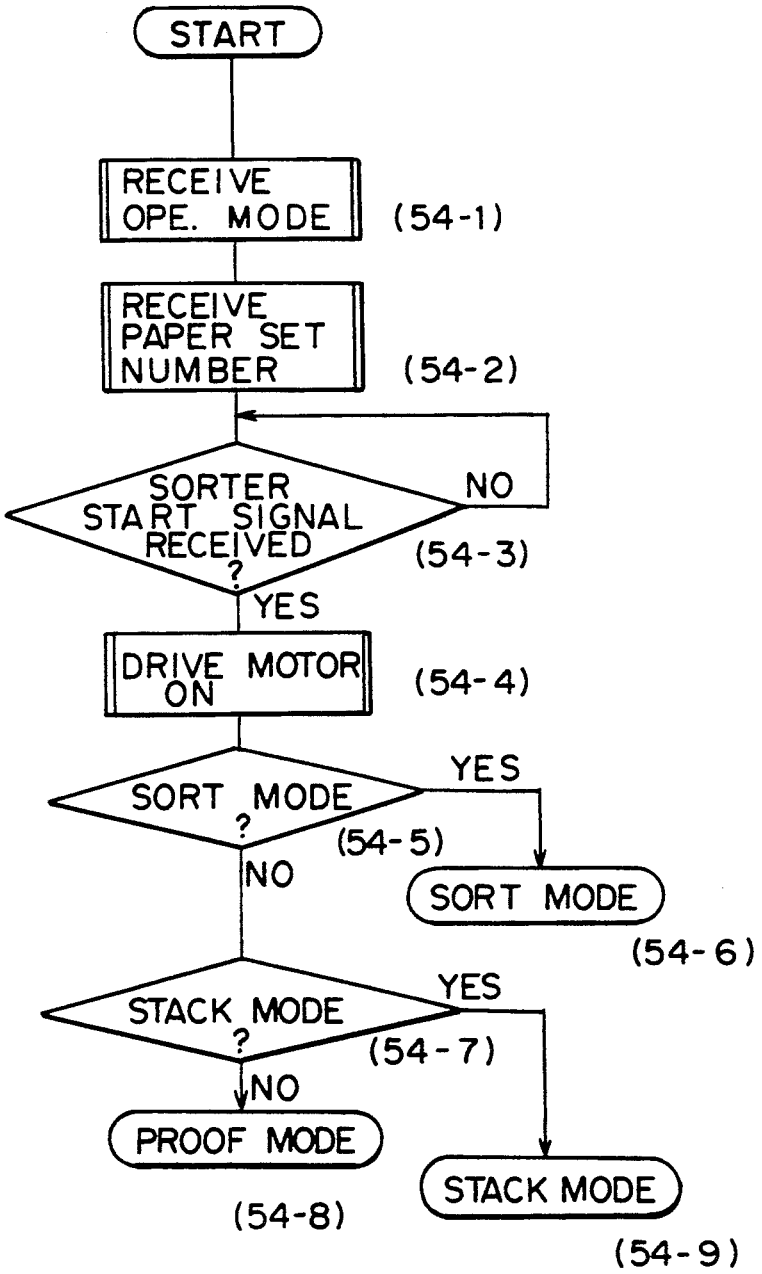
FIG. 12 is a flow chart of the whole function of the device of the present invention.

The operational sequence and the controlling function of the embodiment of the present invention are described hereinafter with reference to the flow charts. The flow of the whole sequence is illustrated in FIGS. 12 and 13.

First, the control system receives an operation mode signal from the copying apparatus (step 54-1). Also, the system receives a paper set number signal from the copying apparatus (step 54-2). After the copying operation is started, a sorter start signal is transmitted from the copying apparatus (step 54-3). Upon receipt of the sorter start signal, the drive motor 200 is turned on (step 54-4) and the operation mode is arranged as the sort mode (steps 54-5 and 54-6). If the sorter start signal is not transmitted, the system is being in the waiting state until the system receives the signal.

Figure 13:
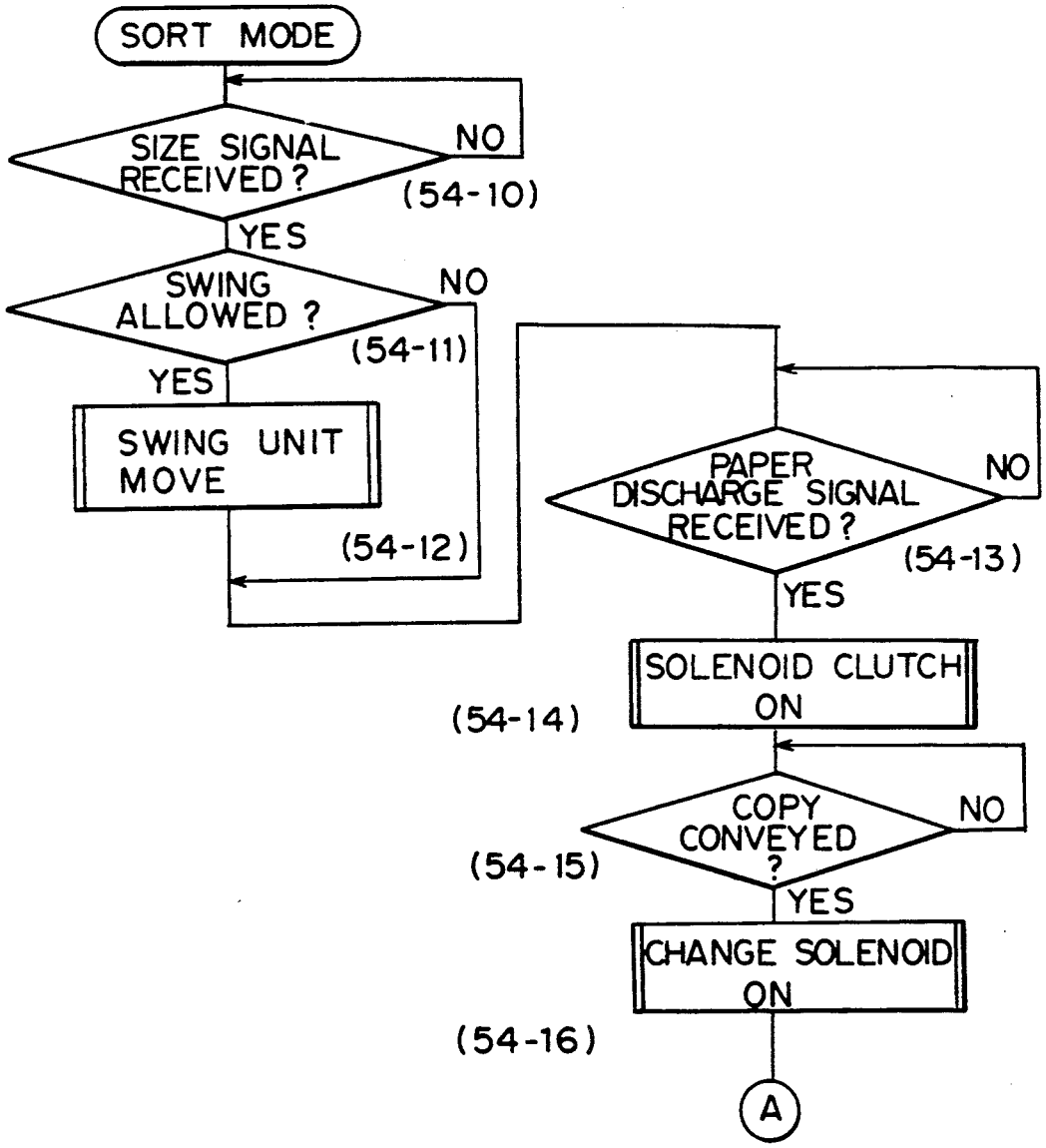
FIG. 13 is a flow chart of the first half sequence of the function of the device in the sort mode.

FIG. 13 illustrates the flow of the operation in the sort mode. At the timing slightly after the above-mentioned sorter start signal is transmitted, a paper size signal indicating the size of the paper fed from the copying apparatus is transmitted from the copying apparatus to the system (step 54-10). Upon receipt of the size signal, the system (CPU) discriminates whether the swinging motion can be carried out or not (step 54-11). If the swinging motion can be operated, the jogger device is moved to the position corresponding to the size of the paper in response to the size signal (step 54-12).

The functions mentioned above are further described below with reference to the sub-routine represented in FIGS. 19 and 20.

Figure 19:
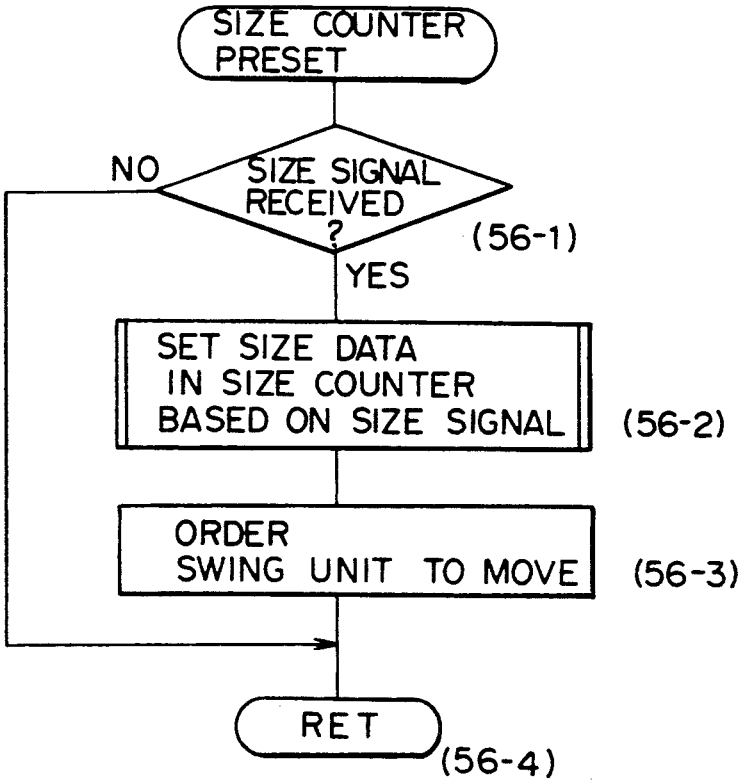
FIG. 19 is a flow chart of the sequence for ordering to move to the jogging unit.

FIG. 19 illustrates a preset motion of the size counter. If the system receives the size signal (step 56-1), the size position data is set in the size counter on the basis of the size signal (step 56-2). Also, a signal for moving the jogging unit is transmitted (step 56-3). After that, the program is returned (step 56-4). If the size signal is not received in step 56-1, the program is returned as it is.

Figure 20:
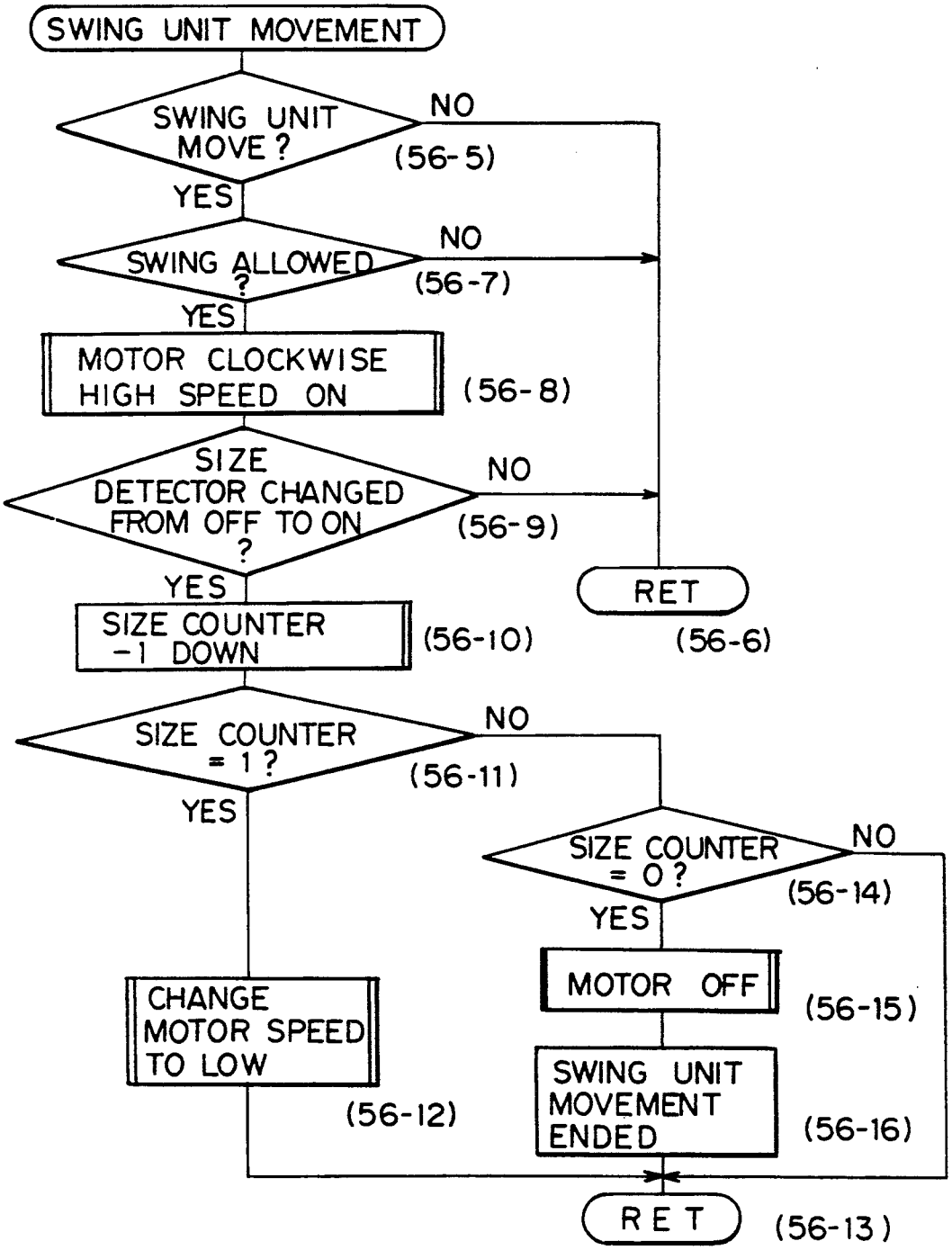
FIG. 20 is a flow chart of the sequence for moving the jogging unit.

FIG. 20 illustrates the flow of the shifting motion of the jogger unit. If the jogger is not to be shifted (step 56-5), the program is returned as it is (step 56-6). If the jogger is to be shifted (step 56-5), the system discriminates whether the swinging motion can be carried out or not (step 56-7). If the discrimination result is YES, the size shifting motor 515 is rotated in the clockwise direction at a high speed (step 56-8). After that, it is discriminated whether the size detection sensor 531 is changed from OFF to ON or not (step 56-9).

If the sensor 531 is not changed from OFF to ON, the program is returned as it is (step 56-6). On the other hand, if the sensor 531 is changed from OFF to ON, the count number of the size counter is decreased by decrement of 1 (step 56-10). After that, it is discriminated whether the size counter counts 1 or not (step 56-11).

If the size counter counts 1, the speed of the motor 515 is lowered (step 56-12) and then the program is returned (step 56-13). If the size counter counts 0 (step 56-14), the motor 515 is turned off (step 56-15) so that the shifting motion of the jogger unit is ended (step 56-16) and the program is returned (step 56-13).

Figure 14:
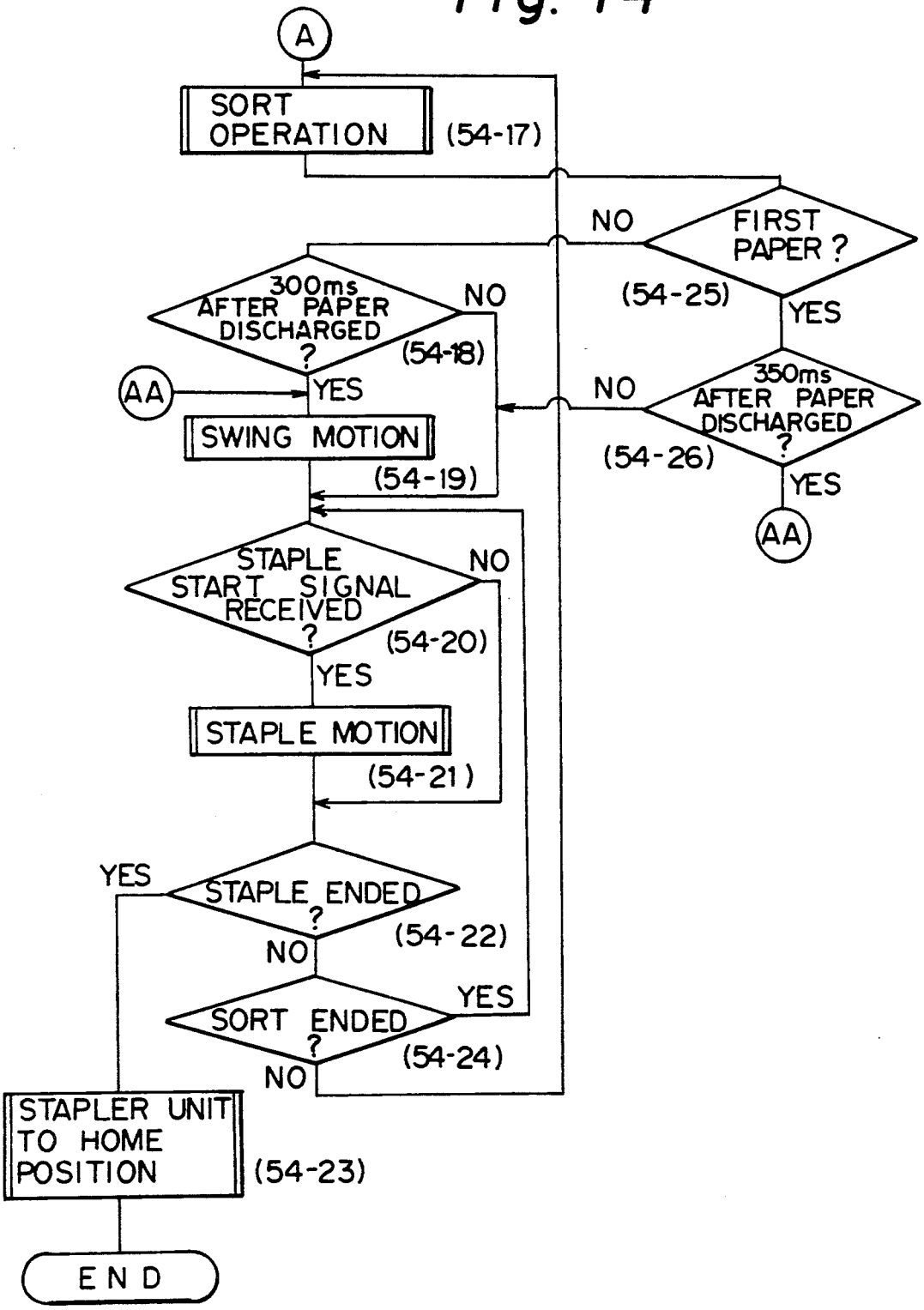
FIG. 14 is a flow chart of the second half sequence subsequent from the sequence of FIG. 13.

Next, referring back to the flow charts of FIGS. 13 and 14, when a copy paper is discharged from the copying apparatus, a copy discharge signal is transmitted (step 54-13). Upon receipt of the discharge signal, the electromagnet clutch (CL) 633 is turned on (step 54-14). After that, the copy is delivered from the copying apparatus so that the inlet sensor 619 is turned on (step 54-15). At the timing when the sensor 619 is turned on, the switching solenoid (SOL) 634 is turned on (step 54-16) so that the changing claw 115 is shifted downward to guide the paper to the bin. Slightly after the timing when the sensor 619 is turned on, one of the SOLs 635 to 654 for a bin to which the paper is to be delivered is turned on. Thereby, the deflection claw 164 is driven to guide the copy to the bin (step 54-17).

If the copy is the first copy, that is, the discrimination result is YES in step 54-25, after a predetermined time (for example 350 ms, step 54-26) is elapsed, which is necessary for the copy to be conveyed onto the bin, the swinging motor 520 is turned on so that the jogging plate is driven to jog the copies (step 54-19).

On the other hand, if the copy is the second copy or a copy after the second copy, that is, the discrimination result is NO in step 54-25, after a predetermined time (for example 300 ms, step 54-18) is elapsed, which is necessary for the copy to be delivered on the bin after being discharged from the copying apparatus, the motor 520 is turned on so that the jogging plate is driven to jog the papers (step 54-19).

It is to be noted that the timing for starting the jogging motion of the plate is controlled on the basis of the timing when the trailing end of the copy is detected.

The above-mentioned predetermined time (300 ms and 350 ms) are basically determined according to the motion of the paper as described below. The copy paper is distributed onto the bin 300 through the rollers 162 and 163. The paper slides along the bin 300 which is inclined upward to the discharging direction outwardly by inertia after discharged from the rollers. After that, the paper slides back downward along the inclined bin surface by the gravity force. Then, the end of the paper reaches near the flange 308 formed along the edge of the bin. The above-mentioned time is determined according to the time from the discharging timing of the paper through the rollers 162 and 163 to the timing when the paper is slidingly moved back to the lower flange of the bin by the gravity. If the time is too short, the paper edges are not properly arranged even.

Therefore, the time is changed depending on the size and kind of the paper. The time may be fixed as a possible maximum value or changed according to the paper being used.

Also, the first paper slides on the bin surface while the second and after the second papers slide on the paper surface. Therefore, the time is changed according to the friction coefficient of the paper and the bin surface. In this particular embodiment of the present invention, the time is elongated when the paper slides along the bin surface when compared with the paper surface. Therefore, the time for the first paper is set as 350 ms which is longer than the time for second and after the second papers which is 300 ms so that the paper edges are reliably arranged even.

Figure 21:
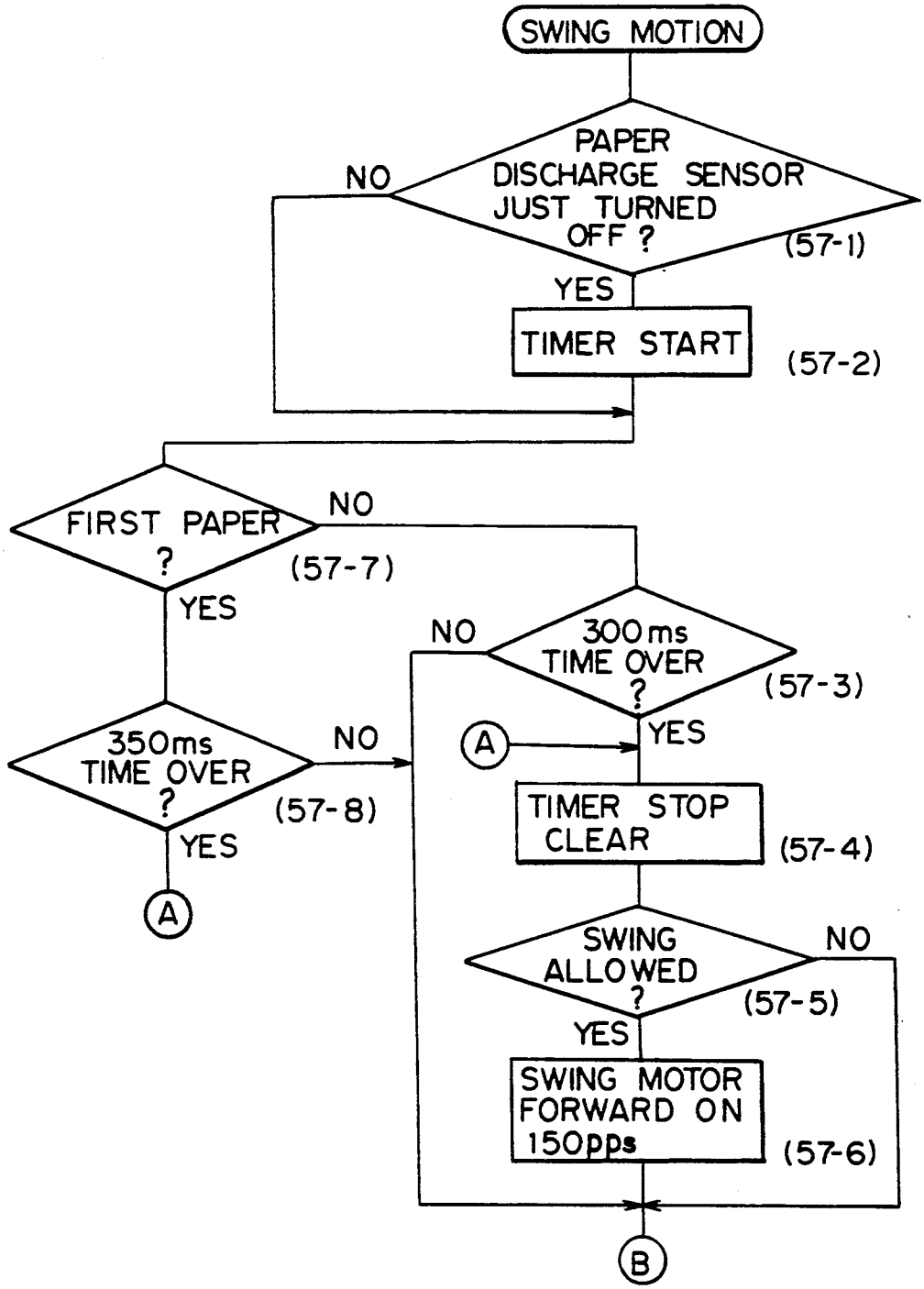
FIG. 21 is a flow chart of the jogging motion.
Figure 22:
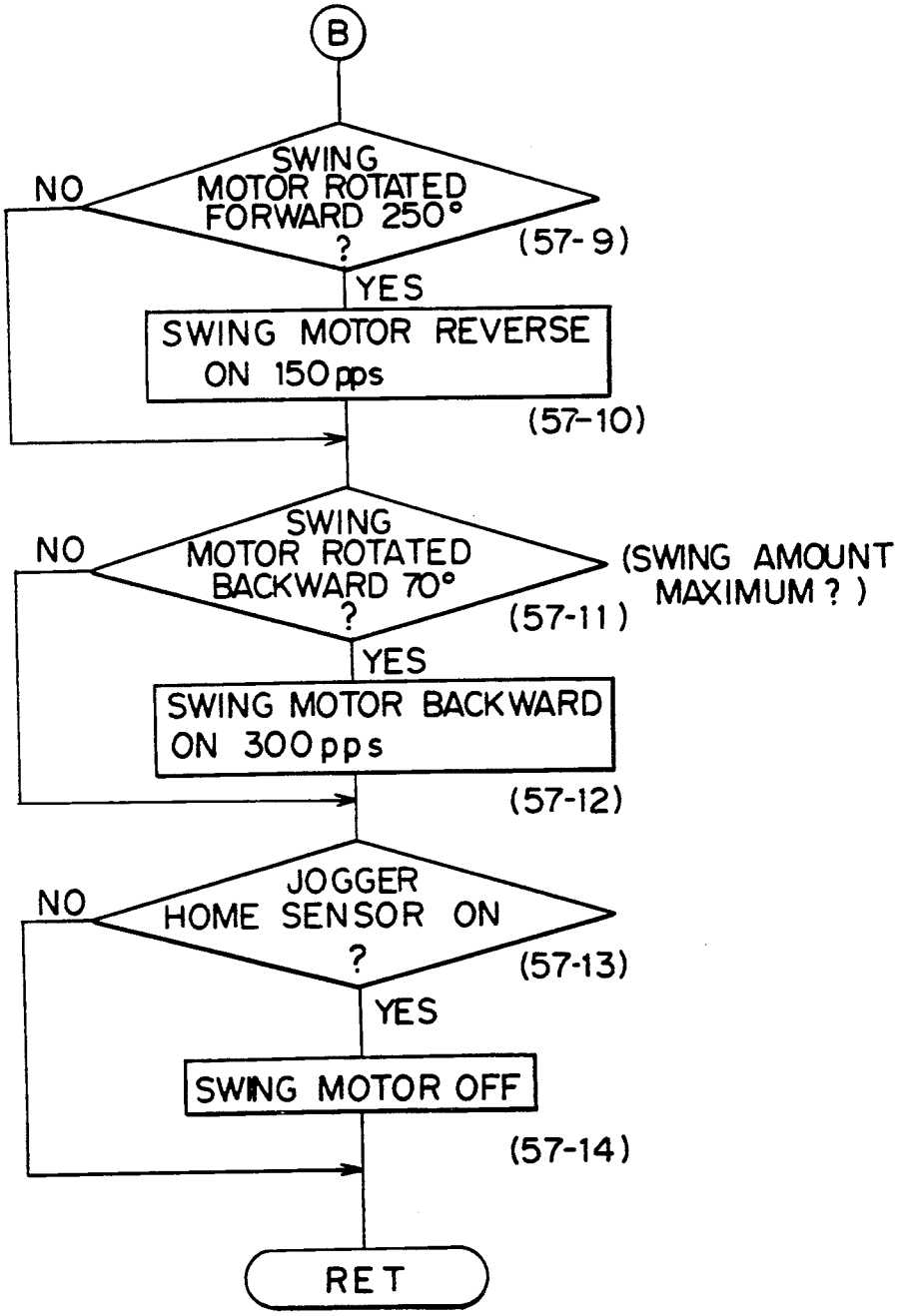
FIG. 22 is a flow chart of the jogging motion subsequent from the motion of FIG. 21.

Next, the jogging motion is described hereinafter with reference to the subroutines of FIGS. 21 and 22.

At the time when the copy is discharged, the upper entry sensor 629 or the lower entry sensor 628 for detecting that the paper is discharged on the bin is turned on first. After that, at the time when the paper discharging motion is finished, the sensor 629 or 628 is changed from being ON to OFF (step 57-1). The point where the sensor is changed from ON to OFF is the trailing end of the paper. At this timing when the sensor is changed from ON to OFF, a timer installed in the CPU 600 is started (step 57-2). The timer is monitored to discriminate whether the paper is the first copy or not (step 57-7). If the discrimination result is YES, the timer is stopped (step 57-4) when 350 ms is elapsed after the timer is started (step 57-8). While if the discrimination result is NO, the timer is stopped (step 57-4) when 300 ms is elapsed after the timer is started (step 57-3).

After that, it is discriminated whether the swinging motion can be carried out or not (step 57-5). If it is possible to conduct the swinging motion, the motor 520 is rotated in the forward direction to conduct the swing motion at 150 pps (step 57-6). When the motor 520 is rotated by 250° in the forward direction (step 57-9), the motor 520 is rotated in the backward direction to conduct the swing motion at 150 pps (step 57-10).

When the motor 520 is rotated by 70° in the backward direction where the swinging amount becomes maximum (step 57-11), the speed of the motor 520 in the backward direction is raised to 300 pps (step 57-12). After that, it is discriminated whether the jogger home sensor is turned on or not (step 57-13). If the sensor is turned on in step 57-13, the motor 520 is turned off (step 57-14).

The above-mentioned jogging motion is conducted each time the copy is discharged. It is to be noted that the jogging motion mentioned above includes the steps 54-17 to 54-19 in FIG. 14.

Next, the stapling operation is described hereinafter. In FIG. 14, when a staple motion start signal is received (step 54-20), the stapling operation is started (step 54-21). When the stapling operation is ended (step 54-22), the stapler unit is shifted to the home-position thereof (step 54-23). The stapling operation is conducted after the sorting motion is ended (step 54-24).

However, in the embodiment of FIG. 14, as can be seen from the flow chart, the stapling operation can be conducted simultaneously with the sorting operation before the sort motion is ended, which makes it possible to efficiently treat the copy papers.

There are two modes of the stapling operation. One is a manual stapling operation mode wherein the papers are stapled after the sorting operation. The other is an auto stapling operation mode wherein the staple motion is automatically started for a bin when the sort operation for the bin is ended while the sort motion is being continued for the other bins.

Figure 16:
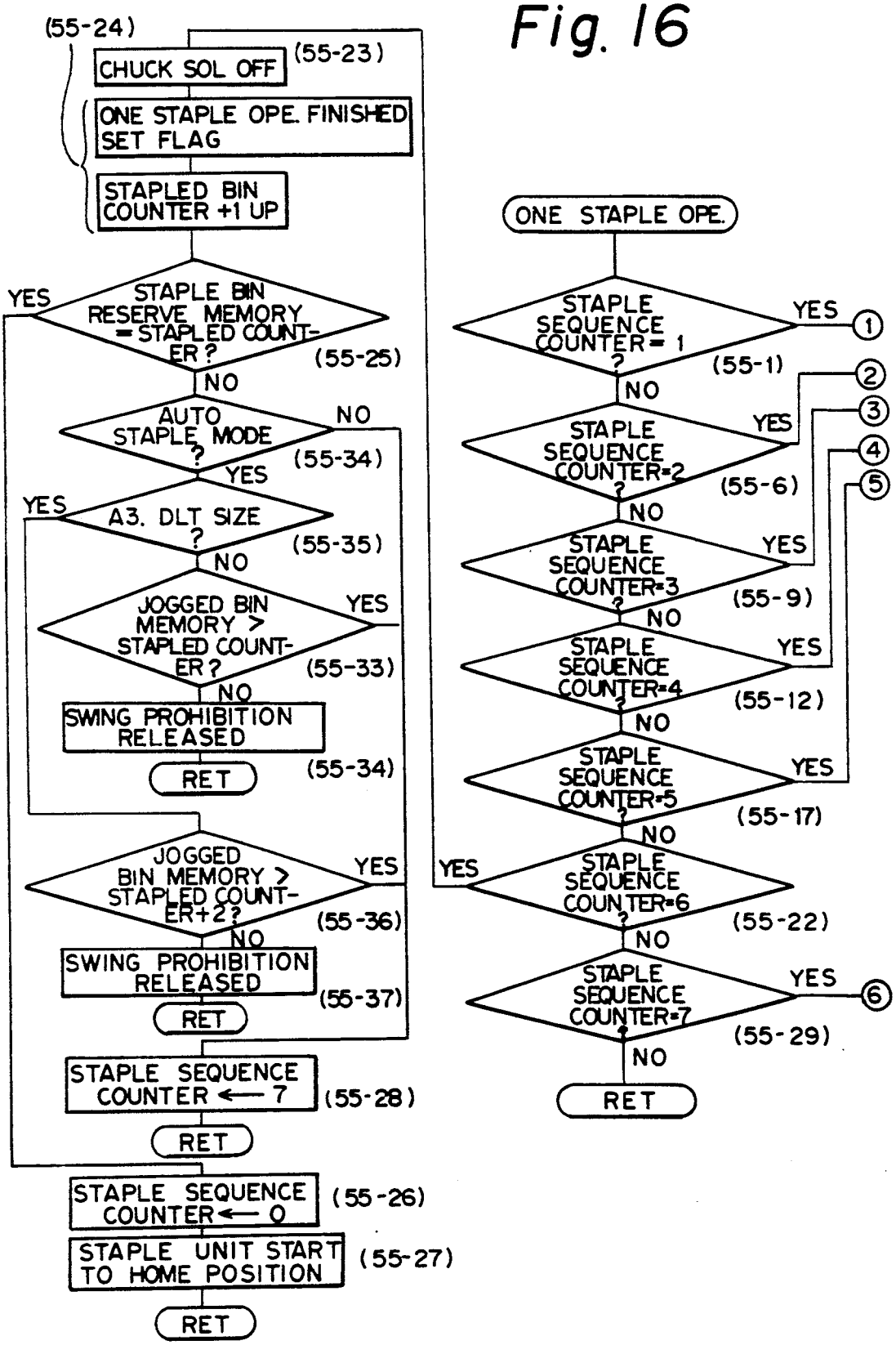
FIG. 16 is a flow chart of the sequence of the stapling function.
Figure 17:
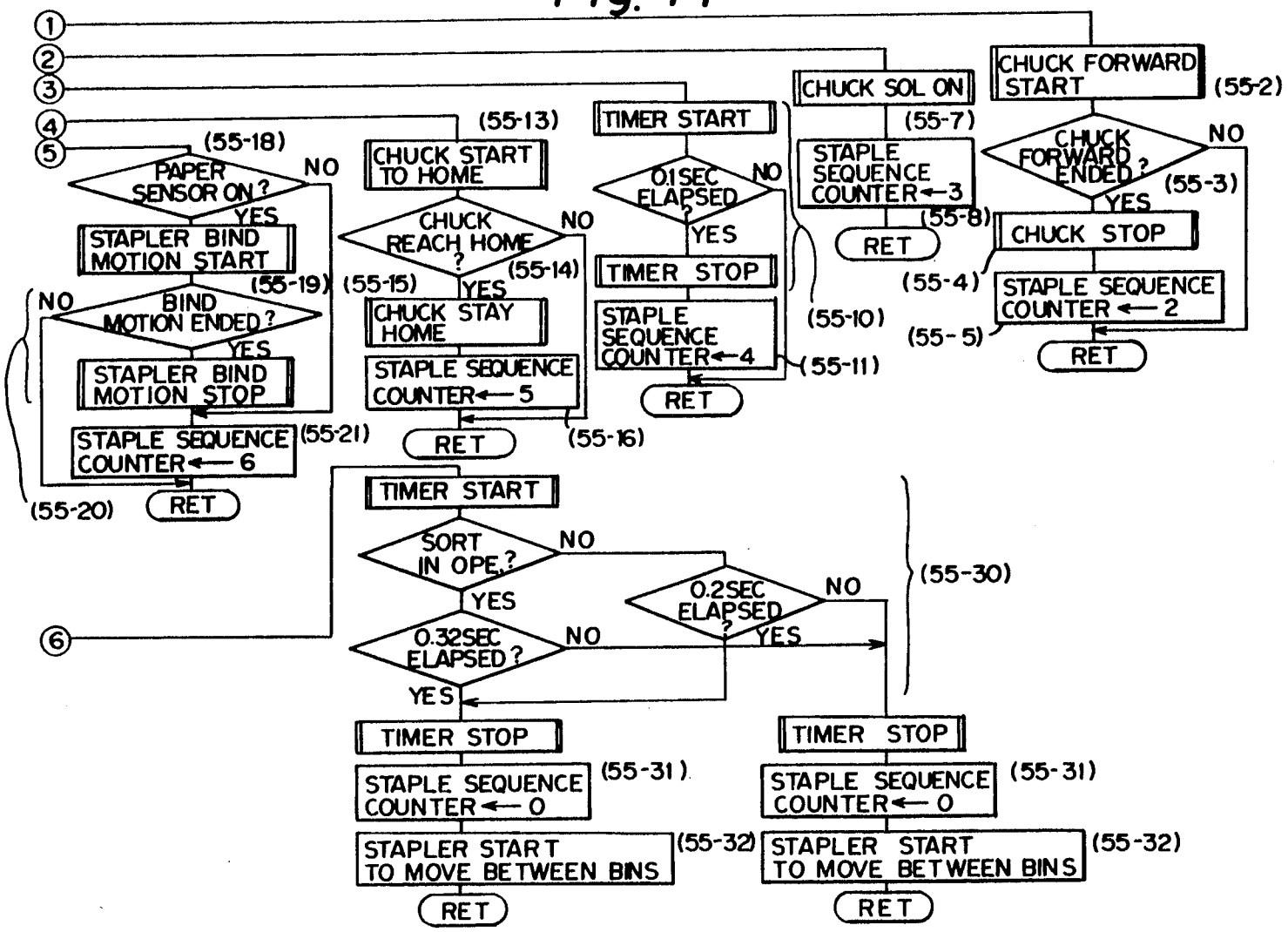
FIG. 17 is a flow chart of the sequence subsequent from the sequence of FIG. 16.

First, the manual staple operation is described with reference to the subroutine of FIGS. 16 and 17.

After the sorting operation is ended, in the state where the copy papers are placed on the bins, a staple motion start signal is transmitted from the copying apparatus. Upon receipt of the start signal, the stapling motion is started. First, the staple 401 is moved from the home-position to the first bin having the papers to be stapled. After the staple 401 is moved to the position of the first bin, the stapling motion is proceeded in accordance with the count number of the staple motion sequence counter as represented in FIGS. 16 and 17.

When the staple 401 is moved to the first bin, the count number of the staple sequence counter is set 1 from 0 (step 55-1). In this state where the count number is 1, the chuck motor **422*f* is turned on so that the chuck unit is moved forward (step 55-2). When the chuck is shifted to a position where the chuck forward sensor 422*j* detects the chuck, the sensor 422*j* is turned on (step 55-3) so that the forward motion of the chuck is ended (step 55-4). In this state, the counter is set as 2 (step 55-5**) and the flow moves to the subsequent steps.

When the set number of the counter is 2 (step 55 6), the chuck SOL **421*c* is turned on (step 55-7) and then the counter is set as 3 (step 55-8**).

When the counter set number is 3 (step 55-9), this state is maintained for 0.1 sec. When 0.1 sec is elapsed (step 55-10), the counter is set as 4 (step 55-11). In the state where the counter is set as 4 (step 55-12), the chuck motor **422*f* is turned on so that the chuck unit is moved to the home-position (step 55-13). The chuck return sensor 422*k* is turned on (step 55-14) when it detects the chuck is moved back to the home-position so that the backward motion of the chuck is ended (step 55-15). Then, the counter is set as 5 (step 55-16**).

When the count number of the counter is 5 (step 55-17), it is discriminated whether the papers are on the bin or not from the output of the paper sensor 623 (step 55-18). If the papers exist, they are bound by the stapler (step 55-19). When the end of the binding motion is detected (step 55-20), the counter is set as 6 (step 55-12). If the papers are not detected by the sensor 623, the flow moves to the subsequent steps without conducting the stapling operation.

When the counter set number is 6 (step 55-22), chuck SOL **421*c* is turned off (step 55-23), and the bin counter for counting the number of the stapled bins is upcounted. Also, the swinging motor is actuated to bias the papers (step 55-24**).

The count number of the stapled bins is compared with the staple reserved bin number which is memorized in a memory and represents the total number of bins having papers to be stapled. If the numbers are coincident (step 55-25), the staple sequence counter is set as 0 so that the stapling motion is ended (step 55-26). After that, the vertical motion motor 409 is turned on so that the stapler unit is moved back to the home-position (step 55-27).

It is described later about the method for calculating the staple reserved bin number and biasing the papers.

If the stapled bin number is smaller than the staple reserved bin number, the staple sequence counter is set as 7 (step 55-28).

When the counter is set as 7, it is discriminated whether the sorter is being in operation or not. If the sorter is not operated, the state is maintained for 0.2 sec for discharging the paper as described later. After 0.2 sec is elapsed (step 55-30), the counter is reset as 0 (step 55-31) and then a command is transmitted to the stapler to move to the subsequent bin as illustrated in the subroutine of FIG. 18 (step 55-32).

On the other hand, if the sorter is being in operation, the state is maintained for 0.32 sec for promoting the swing motion. After 0.32 sec is elapsed (step 55-30), the flow moves to the steps 55-31 and 55-32.

Figure 18:
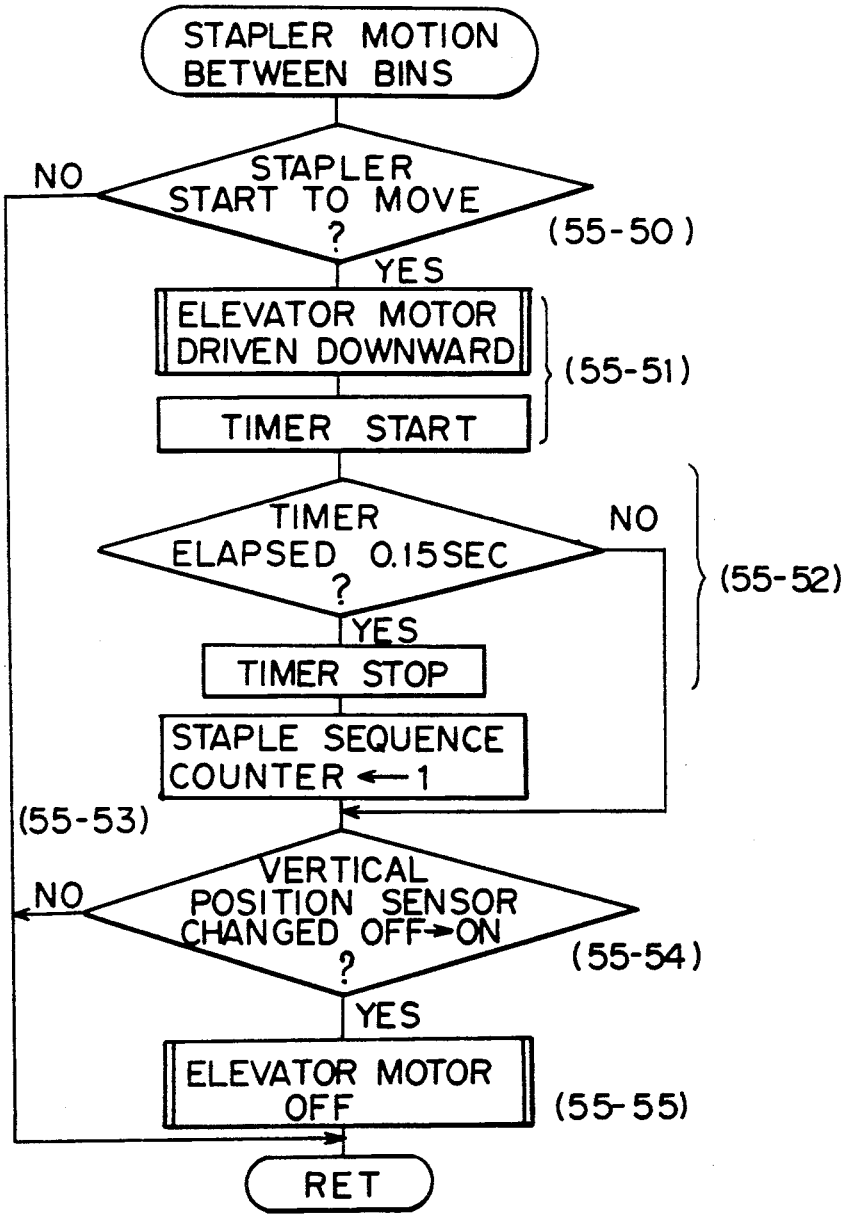
FIG. 18 is a flow chart of the function of the stapler moving between bins in the stapling operation.

The function of the subroutine of FIG. 18 is described below.

First, it is discriminated whether the stapler is to be moved or not. If the stapler is to be moved (step 55-50), the motor 409 is turned on and the timer is started simultaneously (step 55-51). It is discriminated whether the time is over or not (step 55-52). When the time is over, the sequence counter is set as 1 (step 55-53) so that the stapling motion for the next bin is started. Also, whether the vertical position sensor 415 is being on or off is discriminated (step 55-54). When the sensor is changed from being off to on, the vertical motor 409 is turned off (step 55 55) so that the motion of the stapler between bins is ended.

The above-mentioned motion is repeated until the count number of the stapled bins becomes equal to the number of reserved bins to be stapled.

Next, a priority function of stapling the papers in the auto stapling operation and the swinging treatment are described hereinafter.

In the auto stapling operation, the stapling operation is conducted during the sorting operation is being conducted so as to raise the productivity of the system. Therefore, in the auto staple operation mode, the stapling function is carried out at the same time as the swinging function of the sorting operation. However, when the stapling function is conducted at a certain timing in relation to the swinging function, the evenly arranged papers become uneven again by the stapling motion. Therefore, the swinging motion has to be controlled to be allowed or prohibited by the staple priority motion in the auto staple operation mode so that the stapling function and the sorting function can be conducted together without involving the problem, which makes it possible to raise the productivity of the system.

However, the sequence of the stapling motion is asynchronized with the discharging motion of the system while the swinging motion is synchronized with the paper discharging motion. Therefore, the stapling motion and the swinging motion are asynchronized with each other. Accordingly, the swinging allowable time in the staple priority operation is determined according to the stapling motion. That is, if the swinging motion is not conducted in the allowable time (period), the motion at the timing is halted until the next allowable time period is started.

The allowable time in the stapler motion is constant as a result of which when the CPM of the copying apparatus, the allowable timing in the stapling motion becomes lagged from the timing of the swinging motion at the time of discharging the paper, which hinders the swinging motion. (The swinging motion during the time when the paper is being discharged is prohibited so as not to hinder the discharging motion of the paper.) As a result, the jogging treatment (swinging motion) is retarded from the stapling motion so that the stapler unit is set for the bin on which the paper edges are not yet arranged even. The stapling operation must not be conducted for the papers not yet arranged even. Therefore, in such a case, the stapling motion is temporarily halted for a predetermined waiting time (mentioned before) until the swinging motion can be started so that the papers are arranged even. After that, the stapling motion is conducted. If the waiting time is elongated, the stapling motion becomes unsmooth, which makes the user feel unreliable and reduces the productivity of the system.

Figure 25:
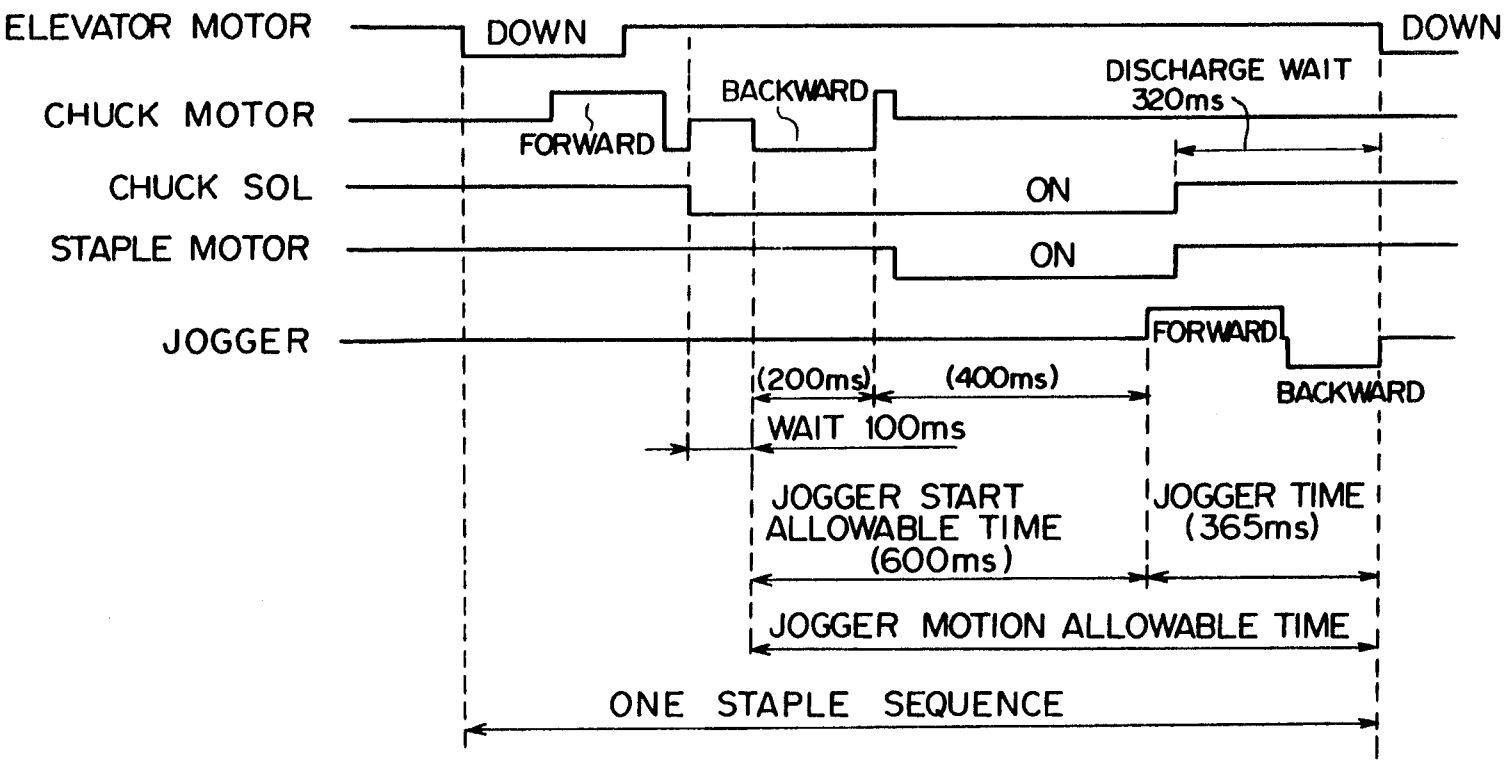
FIG. 25 is a timing chart of the function for prohibiting the jogging motion.

In accordance with the embodiment of the present invention, to cope with the problem mentioned above, the paper discharging wait time represented in the timing chart of FIG. 25 is elongated so that the allowable time for swinging motion is elongated. Essentially, 200 ms is enough for the paper discharging waiting time for the paper to return to the bin. Besides, a dummy time of 120 ms is added to the waiting time to elongate the swinging motion allowable time so as to delete the above mentioned waiting time for starting the swinging motion. By deleting the waiting time for the swinging motion, the additional time of 120 ms can be absorbed and the productivity is enhanced.

Figure 30:
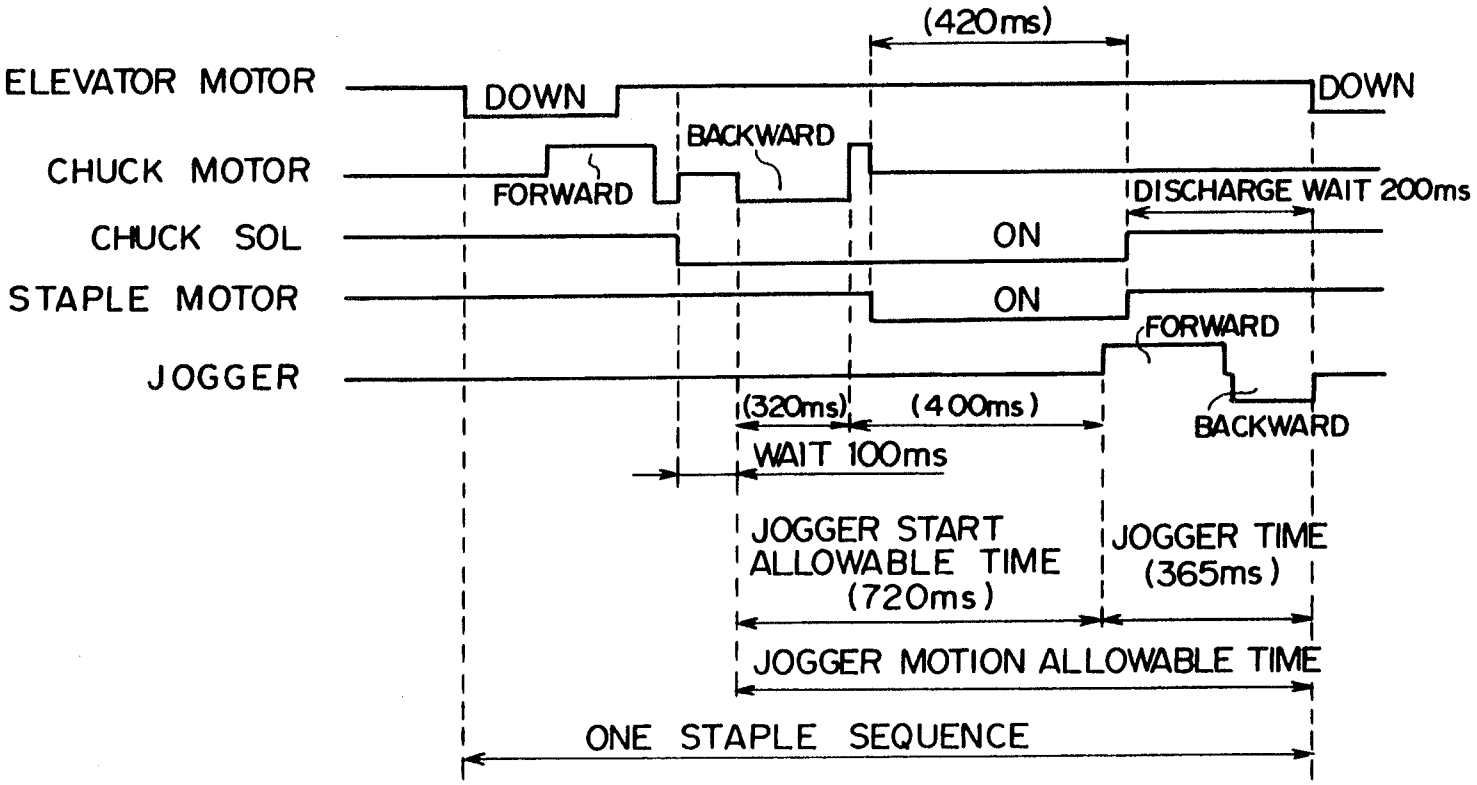
FIG. 30 is a timing chart of another example of the job prohibiting function.
Figure 31:
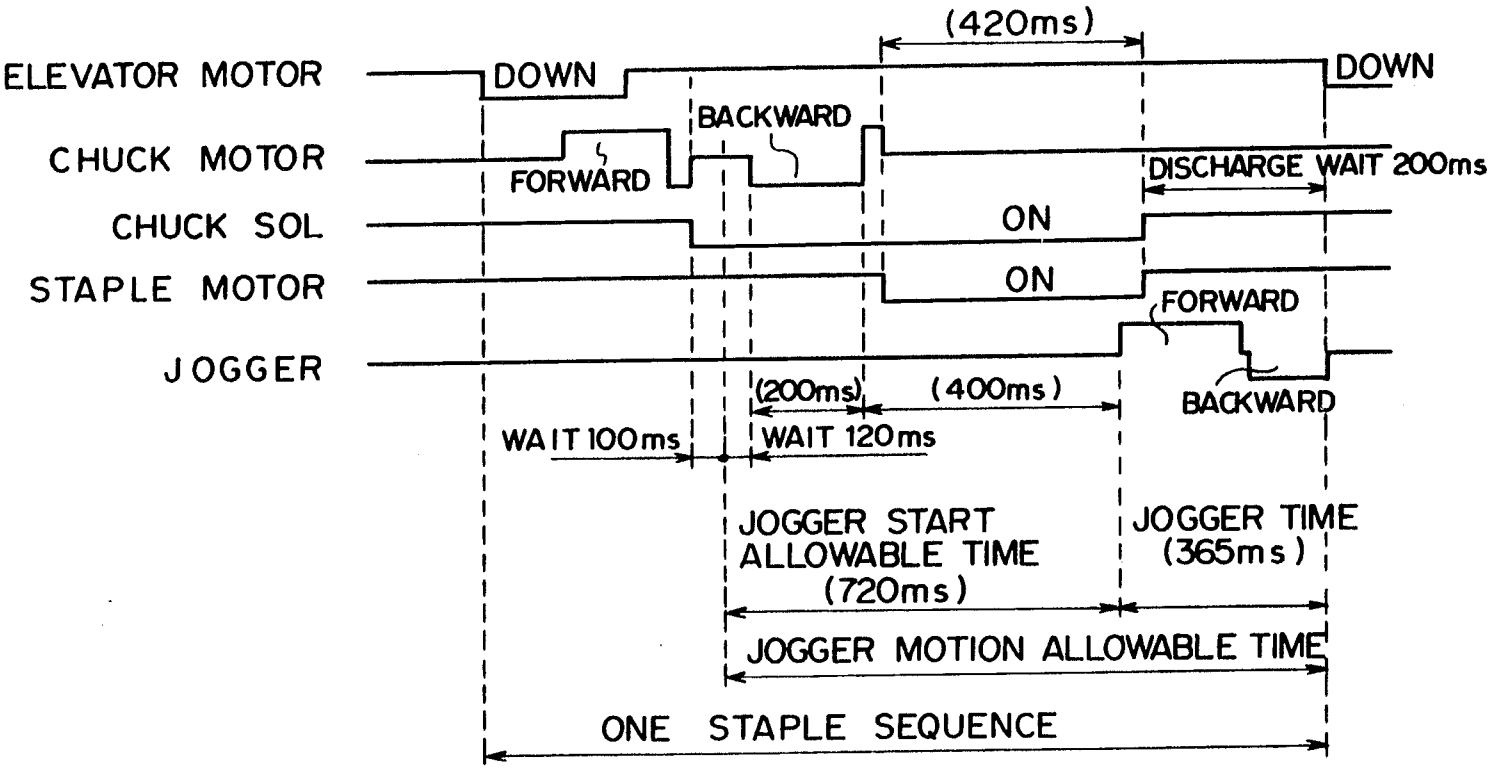
FIG. 31 is a timing chart of still another example of the job prohibiting function.
Figure 32:
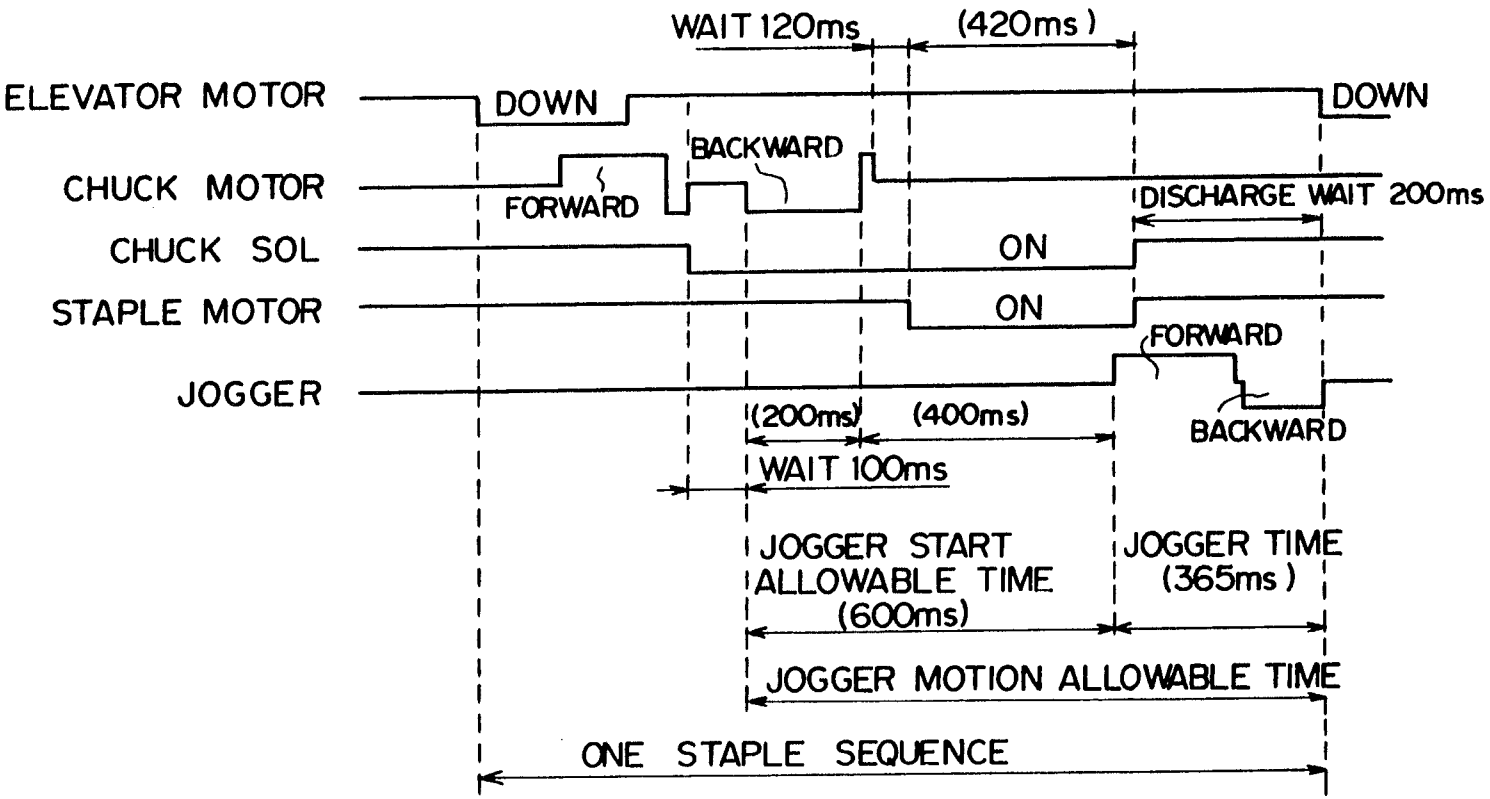
FIG. 32 is a timing chart of a further example of the jog prohibiting function.
Figure 33:
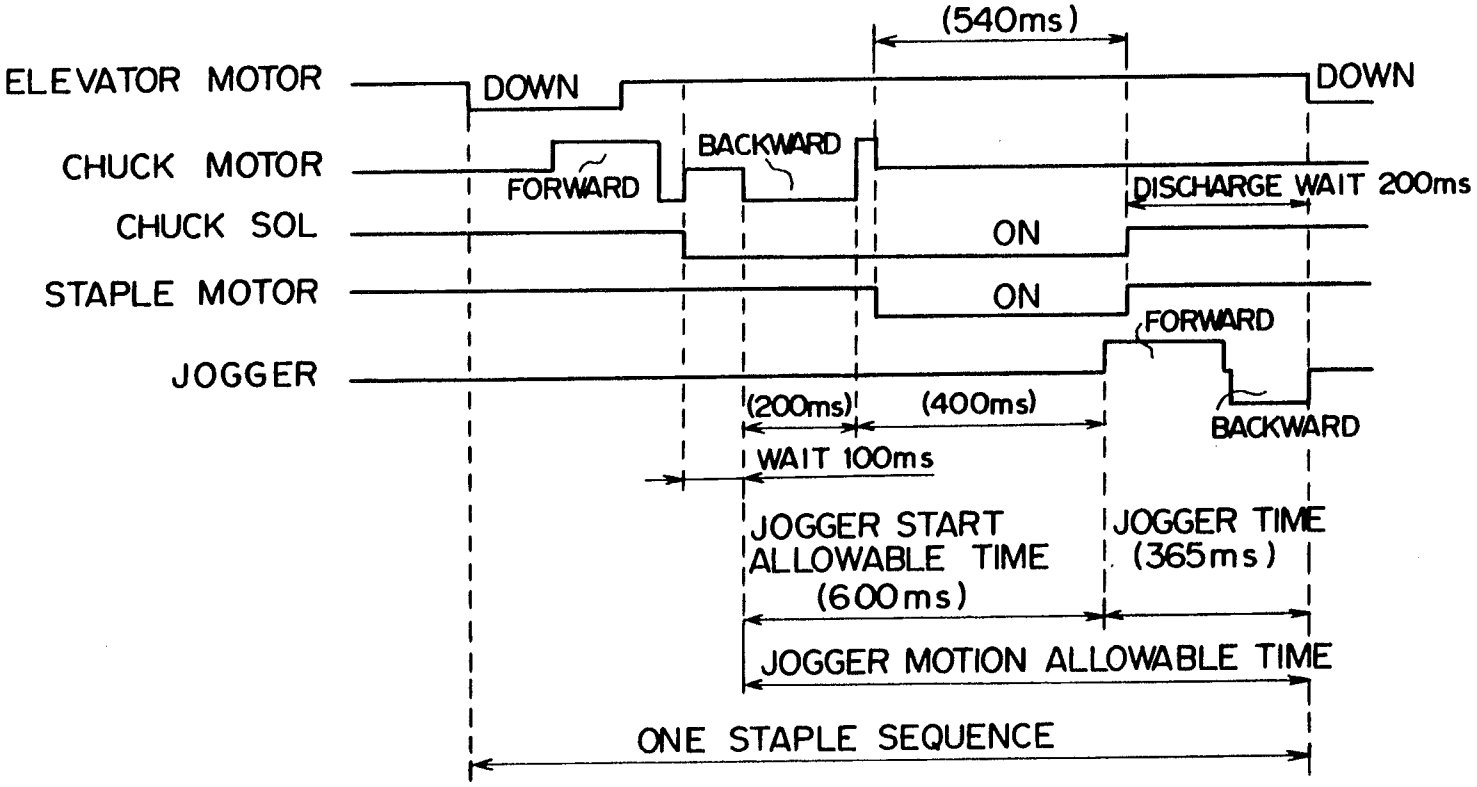
FIG. 33 is a timing chart of a still further example of the job prohibiting function.
Figure 34:
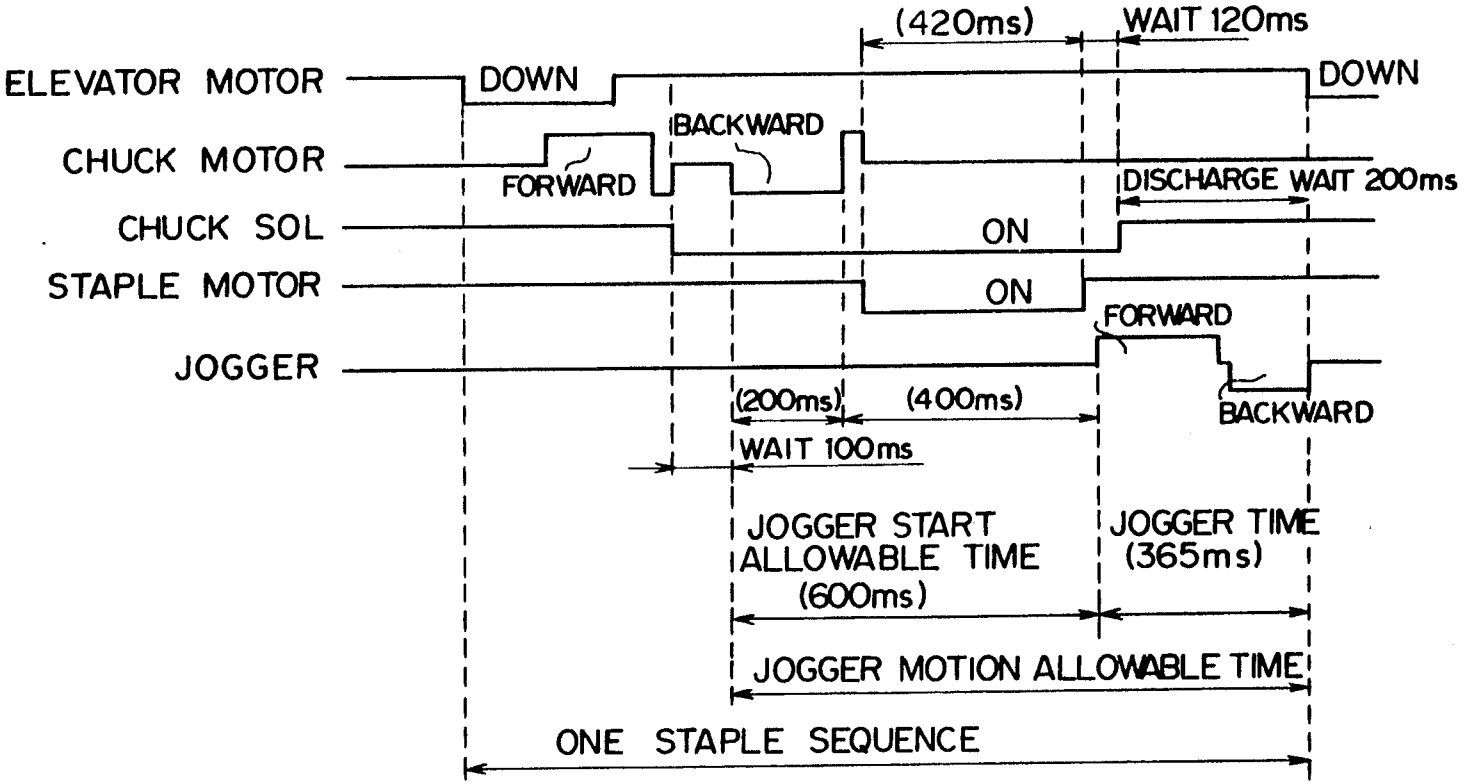
FIG. 34 is a timing chart of a still further example of the jog prohibiting function.

To summarize the embodiment of the present invention mentioned above, the waiting time after the paper bundle is discharged after the stapling operation is elongated by elongating the swinging motion allowable time. This can be achieved by the following ways.

a) The stapler chucks the paper bundle to retard the backward motion thereof as illustrated in FIG. 30.

b) A waiting time is arranged before or after the backward motion as illustrated in FIG. 31.

c) The speed of the stapler motion is reduced to elongate the time as illustrated in FIG. 32.

d) A waiting time is arranged before or after the stapling motion as illustrated in FIGS. 33 and 34.

In the case (a) mentioned above, for example as illustrated in the time chart of FIG. 30, the rotational speed of the chuck motor is reduced in the backward motion to increase the time for the backward motion to 320 ms.

In the case (b) mentioned above, for example, a waiting time of 120 ms is inserted before the backward motion of the chuck. Also, as illustrated in the time chart of FIG. 32, a waiting time of 120 ms may be inserted after the backward motion of the chuck.

In the case (c) mentioned above, as illustrated in the time chart of FIG. 33, the rotational speed of the stapler motor is reduced to elongate the time for the stapling motion to 540 ms by adding 120 ms.

In the case (d) mentioned above, as illustrated in the time chart of FIG. 34, a waiting time of 120 ms is inserted after (or before) the stapling operation.

Figure 37:
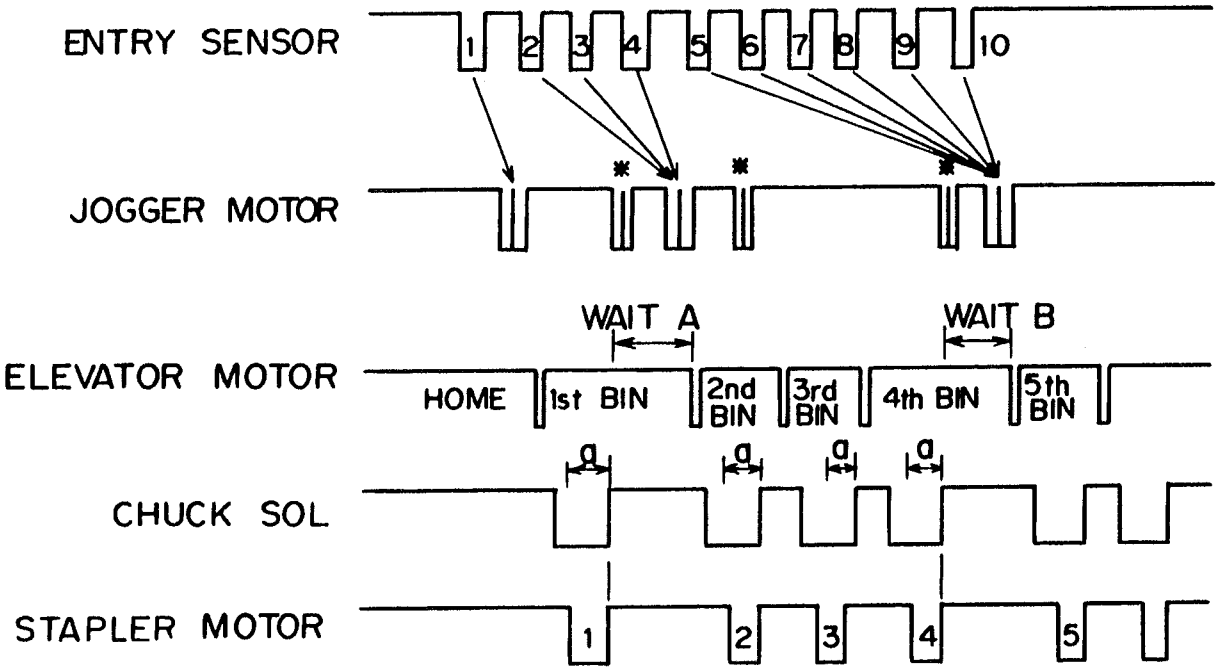
FIG. 37 is a timing chart of the jog prohibiting function in accordance with the related art.

The waiting time is further described with reference to the timing chart. FIG. 37 is a timing chart in which the paper discharging waiting time is arranged as 200 ms without the dummy time of 120 ms. In FIG. 37, "wait A" represents the state wherein the stapler motion is halted since the jogging operation is not yet conducted for the second bin so that the stapling operation can not be conducted for the second bin. Also, "wait B" represents the state wherein the stapler motion is halted since the jogging operation is not yet conducted for the fifth bin so that the stapling operation can not be conducted for the fifth bin. Also, the mark * represents the state wherein a subsequent paper is delivered during the swinging motion so that the swinging motion is not completely achieved.

In the auto stapling operation, in the event that the paper discharging waiting time is 200 ms without the dummy time of 120 ms, as is the case of FIG. 37, the swinging motion allowable time indicated by "a" in the time chart is short so that during the swinging allowable period a subsequent paper is discharged so that the swinging motion can not be conducted since the swinging motion is prohibited during the paper is being discharged and within 300 ms after the paper is discharged. Therefore, the stapler has to wait. In such a waiting state, the staple function is halted so that the time is wasted. Such a loss time due to the waiting state is about 1 sec for a standard A4 size paper. Therefore, if such a wait is generated three times in one operation, about three seconds are elapsed as a loss time.

Figure 27:
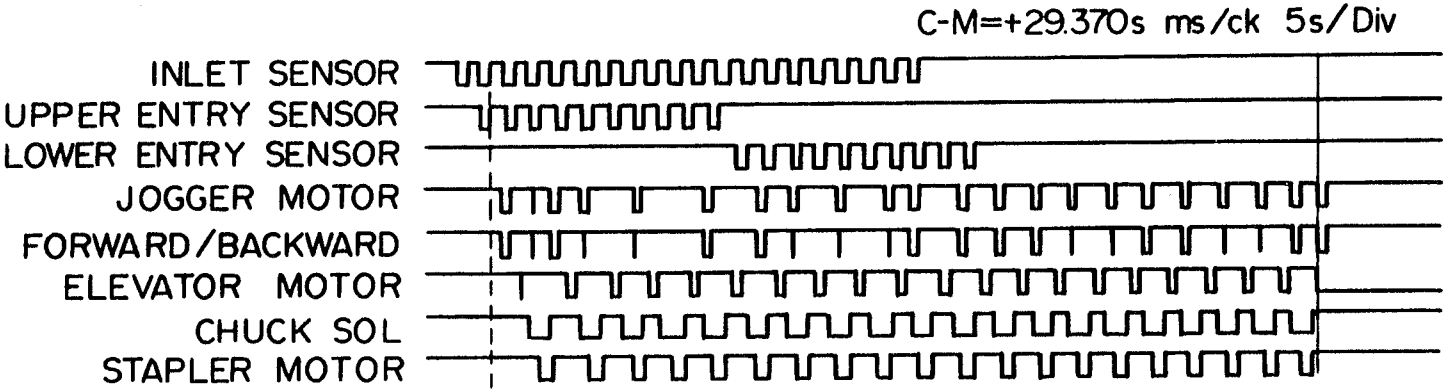
FIG. 27 is a timing chart of the function for prohibiting the jogging motion in the event that the discharge waiting time is 320 ms.

In comparison to the time chart of FIG. 37, FIG. 27 illustrates a time chart wherein the paper discharging wait time is arranged as 320 ms including the dummy time of 120 ms. In accordance with this time chart of FIG. 27, the allowable time period for swinging motion is elongated s that the state of wait is almost deleted. Therefore, the loss time due to the wait state can be deleted. However, in this case, 120 ms of dummy time is generated for one stapling operation. The dummy time is inserted only when the paper sort function and the stapling function are simultaneously conducted in the auto stapling operation mode. In the ordinary 20-bin structure, the sorting operation is conducted simultaneously with the stapling operation until ten bins are stapled. Therefore, the loss time due to the dummy time becomes 120 ms$\times$10 bins=1.2 sec. This loss time is less than the above-mentioned loss time when the dummy time is not arranged so that the waiting time is generated, as is the case of FIG. 37. Accordingly, the productivity can be raised. In the manual stapling operation mode or in the state where the sorting operation is ended in the auto stapling operation mode, the additional dummy time of 120 ms becomes unnecessary, which makes it possible to further increase the productivity.

The concrete result of time measurement of the embodiment of the present invention is as follows.

Figure 26:
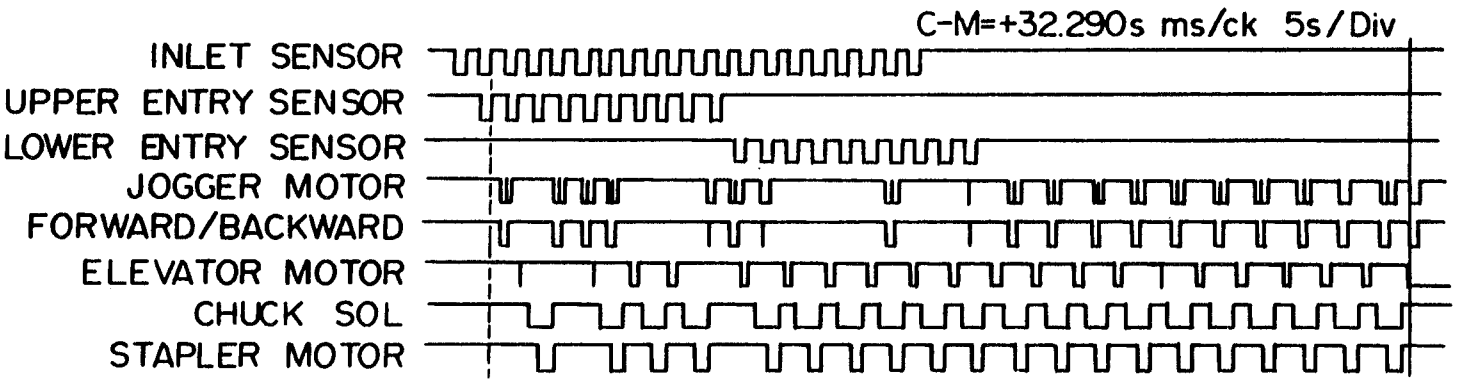
FIG. 26 is a timing chart of the function for prohibiting the jogging motion in the event that the discharge waiting time is 200 ms.

The measurement was made on the condition that the number of originals is ten, the bin number is twenty, the paper size is A4, and the CPM is 72. The test was made to measure the time from the timing when a paper is discharged on the first bin to the timing when the stapling operation for all bins are finished. The time measured was 32.290 sec in the arrangement where the paper discharging wait time is 200 ms, whereas it was 29.370 sec in the arrangement where the paper discharging wait time is 320 ms, which saves 2.92 sec so that the productivity can be enhanced. The measurement results are represented in FIGS. 26 and 27. FIG. 26 represents the case where the paper discharging wait time is 200 ms and FIG. 27 represents the case where the paper discharging wait time is 320 ms.

The auto stapling operation is further described hereinafter with reference to FIGS. 15, 16 and 17. In the middle of the sorting operation, the staple start signal is transmitted at the timing when the first copy of the last original is discharged from the copying apparatus. After the start signal is received, the stapling motion is started at the timing when the swinging motion is conducted for the first copy.

Figure 15:
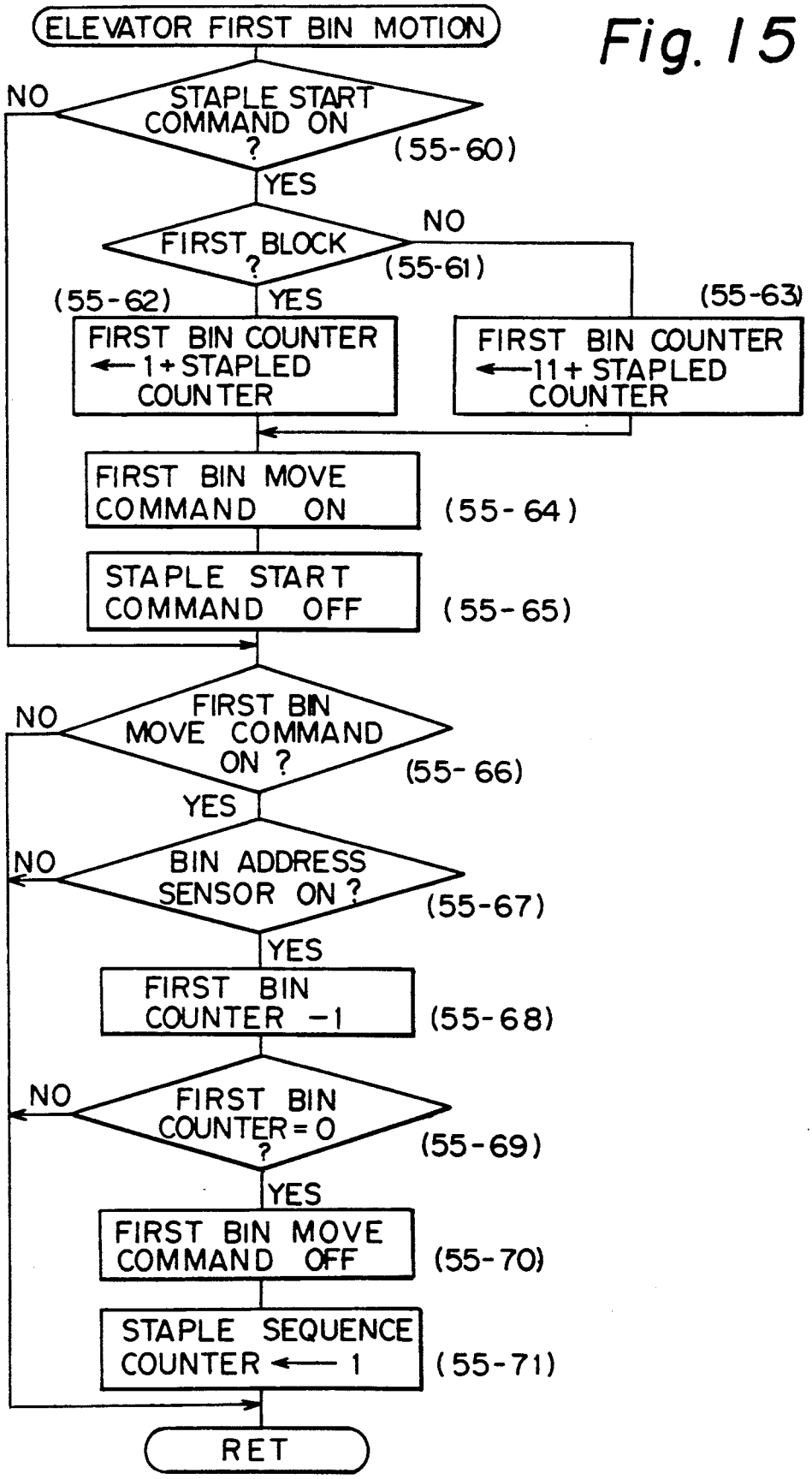
FIG. 15 is a flow chart of the motion of the leading bin in the elevator.

Referring to FIG. 15 first, when the staple start signal is transmitted from the copying apparatus (step 55 60), the block to be stapled is discriminated (step 55-61), that is, the first block is to be stapled or the second block is to be stapled, so as to calculate to determine the bin from which the stapling operation is started. If the first block is to be stapled, 1+the bin number stapled so far in one set of stapling motion is put to the first bin counter which indicates the starting bin (step 55-62) so that the command to move the first bin is turned on (step 55-65).

The stapled bin counter becomes 0 when all of the stapling motion of one set is ended or the function mode is changed. Also, when jam is occurred, or the cover is opened or a staple stop command is transmitted from the copying apparatus, the counter is not cleared so that when the next stapling operation is to be conducted, the operation is started from the unstapled bin without conducting the stapling function for the already stapled bins.

On the other hand, if the discrimination result is NO in step 55-61, that is, the object of the staple is the second block, 11+the bin number stapled so far is put to the first bin counter which represents the starting bin to be stapled (step 55-63). After that, the command to move the first bin is turned on (step 55-65).

When the command to move the first bin is turned on (step 55-65), the elevator motor is turned on so that the stapler descends. After that, it is discriminated whether the bin address sensor is just turned on or not by the detection plate disposed at each bin position in conjunction with the descendent motion of the stapler (step 55-67). If the discrimination result is YES, the first bin counter is decreased by one decrement (step 55-68). When the counter becomes 0 (step 55-69), the command to move the first bin is turned off (step 55-70). Therefore, the elevator motor is stopped at the position of the first bin. The staple motion is started by putting 1 to the staple sequence counter (step 55-71).

In a manner as mentioned above, the stapler 401 is moved from the home-position to the position of the first bin. After the stapler is moved to the first bin, the sequence is proceeded in accordance with the set number of the staple motion sequence counter represented in the subroutine of FIGS. 16 and 17.

When the stapler 401 is moved to the first bin, the staple sequence counter is set as 1 from 0 (step 55-1). When the sequence counter is set as 1, the chuck motor is turned on to move the chuck unit forward (step 55-2). When the chuck is shifted to a position where the chuck forward sensor detects the chuck, the sensor is turned on (step 55-3) so that the forward motion of the chuck is ended (step 55-4). In this state, the counter is set as 2 (step 55-5) and the flow moves to the subsequence steps.

When the set number of the counter is 2 (step 55-6), the chuck SOL is turned on (step 55-7) and then the counter is set as 3 (step 55-8).

When the counter set number is 3 (step 55-9), this state is maintained for 0.1 sec. When 0.1 sec is elapsed (step 55-10), the counter is set as 4 (step 55-11). In the state where the counter is set as 4 (step 55-12), the chuck motor is turned on so that the chuck unit is moved to the home-position (step 55-13). The chuck return sensor is turned on (step 55-14) when it detects the state the chuck is moved back to the home-position so that the backward motion of the chuck is ended (step 55-15). Then, the counter is set as 5 (step 55-16).

When the count number of the counter is 5 (step 55-17), it is discriminated whether the papers are on the bin or not from the output of the paper sensor 623 (step 55-18). If the papers exist, they are bound by the stapler (step 55-19). When the end of the binding motion is detected (step 55-20), the counter is set as 6 (step 55-12). If the papers are not detected by the sensor 623, the flow moves to the subsequent steps without conducting the stapling operation.

When the counter set number is 6 (step 55-22), chuck SOL is turned off (step 55-23), and the bin counter for counting the number of the stapled bins is up-counted. Also, the swinging motor is actuated to bias the papers (step 55-24).

The count number of the stapled bins is compared with the staple reserved bin number which is memorized in a memory and represents the total number of bins having papers to be stapled. If the numbers are coincident (step 55-25), the staple sequence counter is set as 0 so that the stapling motion is ended (step 55-26). After that, the vertical motion motor is turned on so that the stapler unit 400 is moved back to the home-position (step 55-27).

It is described later about the method for calculating the staple reserved bin number and biasing the papers.

If the count number of the stapled bins is smaller than the staple reserved bin number, the count number is compared to the memorized number of jogged bins (step 55-33). If the jogged bin number is larger than the stapled bin number, the staple sequence counter is set as 7 and the flow moves to the next step.

If the jogged bin number is smaller than or equal to the stapled bin number (step 55-33), the stapler maintains the state as it is and the swing prohibition treatment is released (step 55-38) so that the swinging motion is proceeded. In a manner as mentioned above, the priority means is determined between the paper arrangement means (swinging motor) and the stapling means (stapler unit 400).

Also, as for the predetermined size (step 55-35), if the jogged bin number is larger than the stapled bin number by 2 or more, the staple sequence counter is set as 7 (step 55-36) and the flow moves to the next step. If the number is less than 1, the stapler maintains the state as it is and the swinging motion prohibition treatment is released (step 55-37) so as to proceed the swinging motion.

Note that the swinging motion prohibition treatment and the calculation for obtaining the jogged bin number are described later.

As mentioned above, it becomes possible to conduct the swinging function at least two times for the set of papers to be stapled.

In the process of the swinging operation, when the jogged bin number (number of bins to which the swinging function is conducted) becomes larger than the stapled bin number, by 2 or more in the case of the predetermined size, the staple sequence counter is set as 7 (step 55-28). When the counter is set as 7, the state is maintained for 0.32 sec. When 0.32 sec is elapsed, the staple start signal is transmitted to the above-mentioned subroutine of FIG. 18 to staple the next bin. Also, if the sorting operation is finished, the state is maintained for 0.2 sec. After 0.2 sec is elapsed, the staple start signal is transmitted for the next bin.

Figure 23:
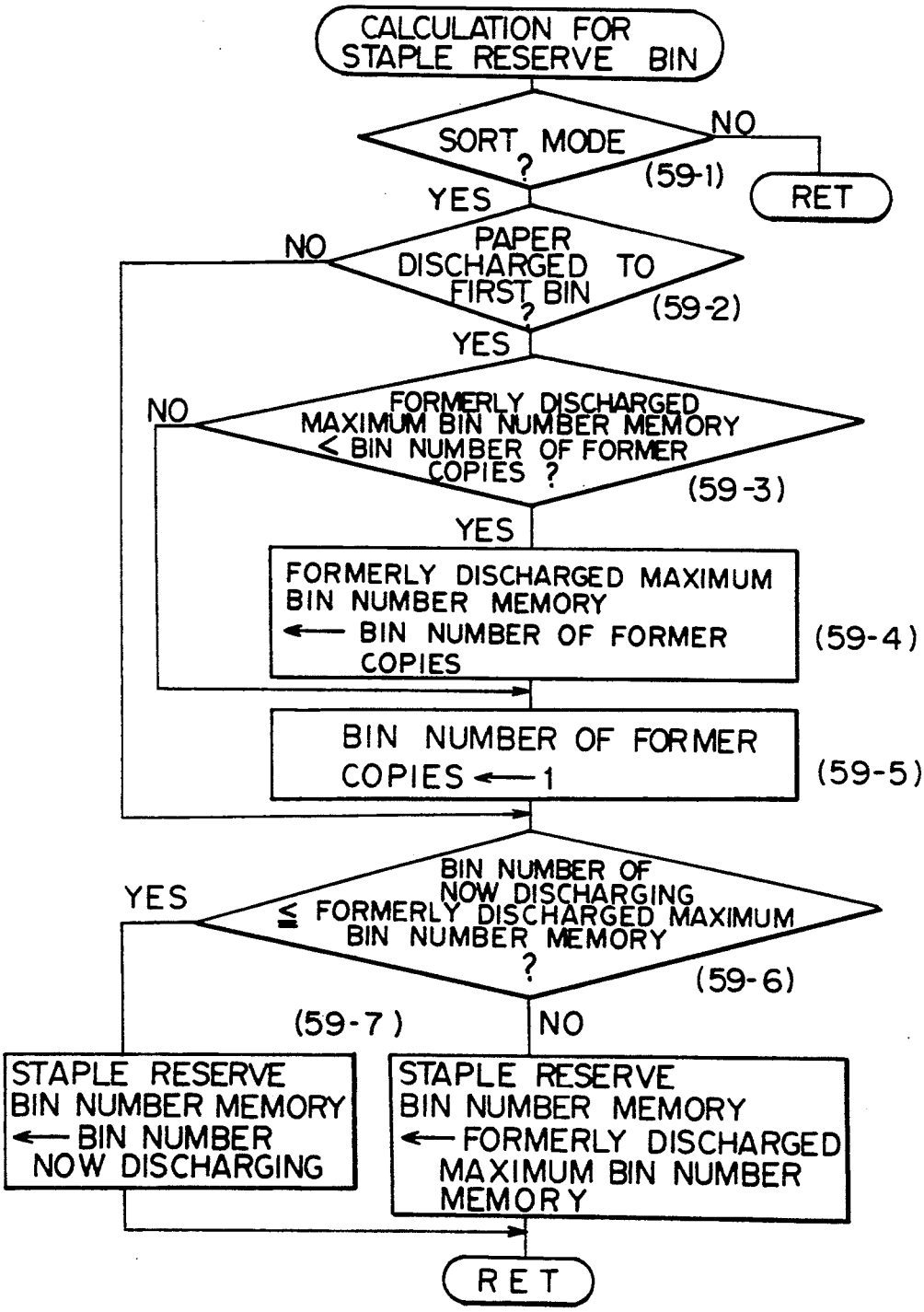
FIG. 23 is a flow chart of the sequence for calculating the stapling reservation bin.

Calculation for determining the bins to be reserved for conducting the stapling operation is described below with reference to the subroutine of FIG. 23.

The calculation system in accordance with the embodiment comprises a first memory for memorizing the number of bins to which the copying apparatus discharged the copy of the former original in the sort mode operation for each original, a second memory for memorizing the maximum number of bins to which the copies are discharged in one sorting operation, and a third memory for memorizing the number of bins to be reserved for stapling. The calculation is conducted as follows in accordance with the data of the memories.

The copying operation is started in the sorting mode (step 59-1). At the timing when the copy is discharged from the first bin of the sorter (step 59-2), the data of the first memory is compared with the data of the second memory (step 59-3). If the first memory data is larger than the second memory data, the first memory data is substituted for the data of the second memory (step 59-4). Also, numeral 1 is substituted for the data of the first memory (step 59-5).

The data of the first memory increases as 2, 3, . . . accordingly as the copies are discharged to the second bin, the third bin, . . . .

The number of the bins to which the copies are now being discharged is compared with the maximum number of the bins memorized in the second memory (step 59-6) so that the smaller number between the two is substituted for the data of the third memory (step 59-7). The data of the third memory changes according to the situation so that it becomes possible to cope with the case where the stapling function is to be conducted simultaneously with discharging copies as in the operation of auto stapling mode.

The function is further described below.

For example, it is assumed that the copies of the original of page 1 are reserved in the tenth bin to be stapled, the copies of page 2 are reserved in the fifth bin to be stapled and the copies of page 3 are reserved in the seventh bin to be stapled.

First, the copy of the original of page 1 is discharged to the first bin. At this time, the maximum bin number M of the formerly discharged copies memorized in the second memory and the bin number of the formerly discharged copies memorized in the first memory are both 0. Therefore, the discrimination result in step 59-3 becomes NO so that data 1 is put to the first memory (step 59-5). After that, in step 59-6, the number of bins to which the copies are now being discharged is compared with the data of the second memory. When the copies of page 1 of the original are discharged to the tenth bin, the bin number of now being discharged is 10 and the bin number M of the second memory is 0. Therefore, the discrimination result in step 59-6 becomes NO so that data 0 is put to the third memory.

After that, the copy of the original of page 2 is discharged to the first bin. At this time, the data M of the second memory is 0 and the data of the first memory is 10 (which is upcounted in the other routine), so that the discrimination result in step 59-3 becomes YES so that the data 10 is put to the second memory as the maximum bin number M. When the copies of page 2 are discharged to the fifth bin, the bin number now being discharged is 5 and the maximum bin number M memorized in the second memory is 10. Therefore, the discrimination result in step 59-6 becomes YES so that the data 5 is put into the third memory.

Finally, the copy of page 3 of the original is discharged to the first bin. At this time, the data M of the second memory is 10 and the data of the first memory is 5. Therefore, the discrimination result in step 59-3 becomes NO so that the data of the second memory is maintained as 10. When the copies of page 3 are discharged to the seventh bin, the number of bins now being discharged is 7 and the bin number of the second memory is 10. Therefore, the discrimination result in step 59-6 becomes YES so that data 7 is put into the third memory. Accordingly, the copies in the bins to which the copies of the last page of the original are discharged are stapled.

In accordance with the process mentioned above, it becomes possible to apply the stapler means 400 to the bins to which the copies of the last page of the original are discharged so that the set of copies of full pages as possible can be binded.

Also, it is possible not to apply the stapler means 400 to the bins on which only one copy is discharged, thereby preventing an unnecessary stapling operation when the number of copies of the original of the last page is changed.

Figure 24:
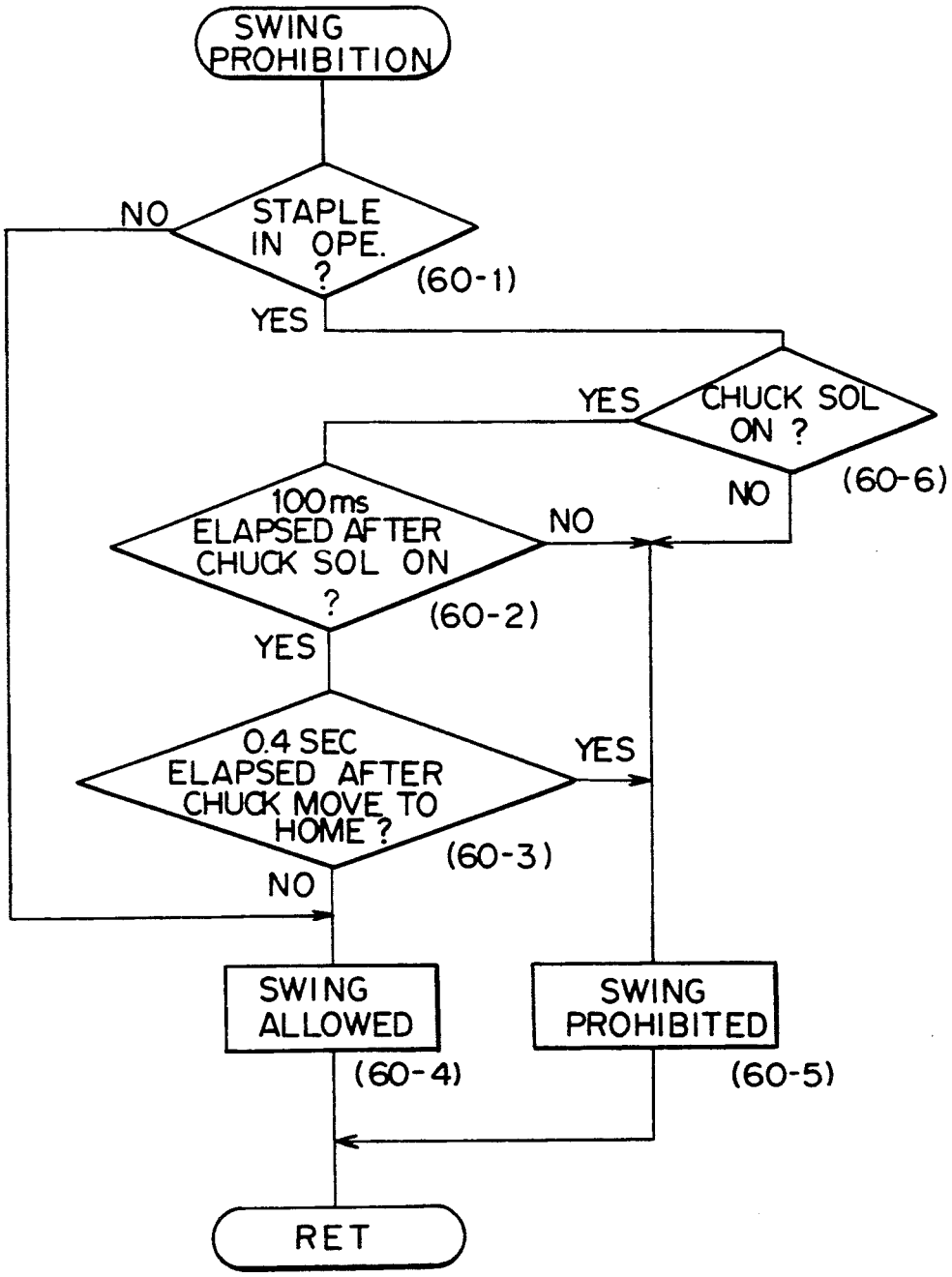
FIG. 24 is a flow chart of the sequence for prohibiting the jogging motion.

The staple priority swing motion prohibiting treatment is described hereinafter in accordance with the subroutine of FIG. 24.

The jogger start permission time of FIG. 25 is from the timing when 100 ms is elapsed after the chuck SOL is turned on to the timing when 400 ms is elapsed after the chuck comes to the home-position in the backward motion thereof. That is, the time is during the time when the paper bundle is reliably held by the chuck even if the fence is opened and when the paper bundle is being returned to the bin (jogger motion allowable time) minus jogger operation time. This is represented in the flow chart of FIG. 24.

First, it is discriminated whether the stapling operation is being conducted or not (step 60-1). If the discrimination result is YES, whether the chuck solenoid SOL is being turned on or not is checked (step 60-6). If the discrimination result is YES, whether 100 ms is elapsed or not after the chuck SOL is turned on is checked (step 60-2). If YES, then it is discriminated whether 0.1 ms is elapsed or not after the chuck is moved to the home-position (step 60-3). If NO, the swinging motion is permitted (step 60-4). If the chuck SOL is not turned on, the swinging motion is prohibited (step 60-5). Also, if 0.4 ms or more is elapsed after the chuck is moved to the home-position, the swing motion is prohibited and the sequence is returned. Also, if the stapling operation is not being conducted, the swing motion is permitted without any restrictions and the sequence is returned.

In accordance with the process mentioned above, the timing of the paper arrangement motion becomes coincident with the stapling motion so that the paper edges are reliably arranged even and the stapling position is not dislocated.

Figure 28:
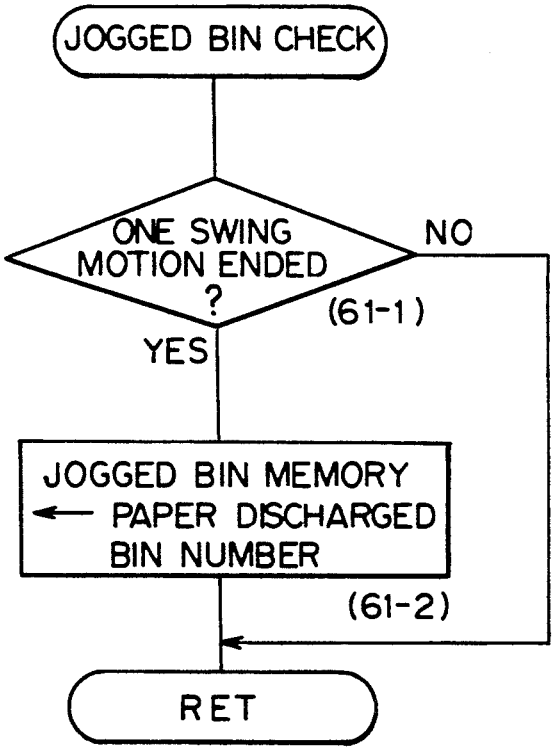
FIG. 28 is a flow chart of the sequence for checking the jogged bin.

Next, the calculation process for obtaining the number of bins to which the swinging motion was applied is described in accordance with the subroutine of FIG. 28.

First, whether the swinging motion is conducted at least one time or not is checked (step 60-1). If the swinging motion is not conducted at all, the sequence is returned as it is. If the swinging operation is conducted once, the number of the bins to which the papers are discharged is registered in the memory for memorizing the number of jogged bins to which the swinging motion was conducted (step 61-2) and then the sequence is returned. The paper discharged bin number represents the number of bins to which the papers were discharged so far. The jogged bin number represents the number of bins to which the swinging motion was conducted so far.

Figure 29:
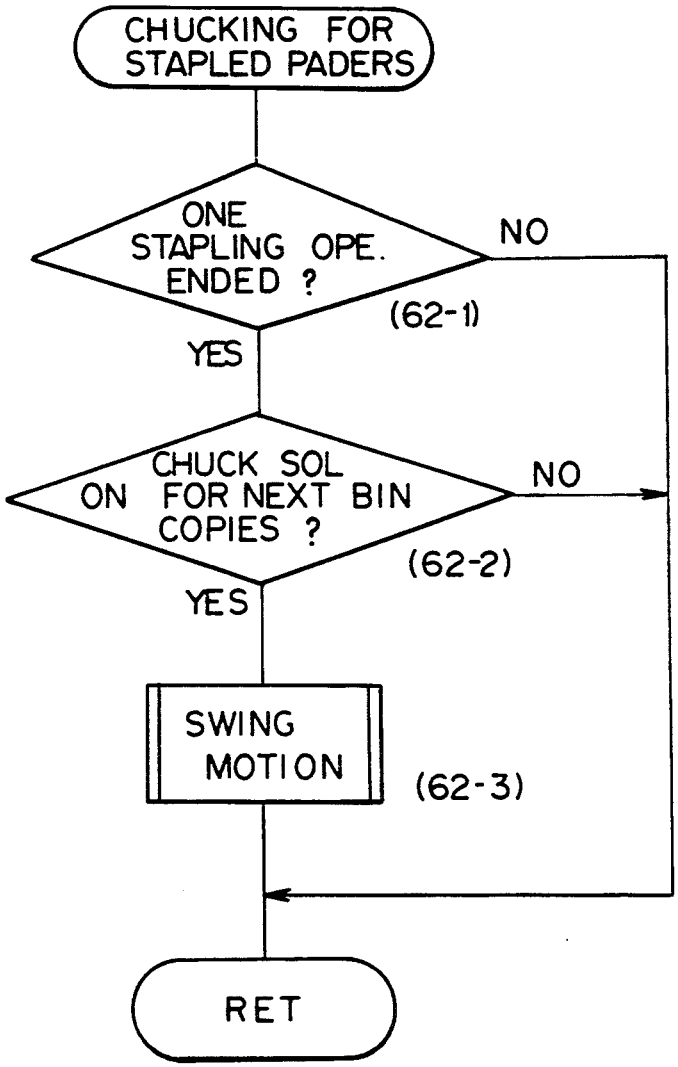
FIG. 29 is a flow chart of the function of the chuck for holding the paper to be stapled.

Paper shifting function for moving the papers for stapling another bundle of papers is described hereinafter in accordance with the subroutine of FIG. 29.

After the stapling motion is ended (step 62-1), when the chuck solenoid is turned off, the stapled copies are moved on the bin by the paper push back bracket to the position within the rotational range of the swinging plate. Thereby, one stapling operation is finished. At this time, a flag representing the end of one staple operation is set in the subroutine of FIGS. 16 and 17. The end of one stapling operation is discriminated from the data of the flag. If it is judged that one stapling operation is finished, the stapler is moved to the next bin to which another stapling operation is to be applied. In the next stapling operation, when the chuck SOL is turned on (step 62-2), the swinging motion is started (step 62-3). The stapled papers of the preceding bin is moved to a predetermined place so that the stapled paper bundle on the bin does not hinder the paper arranging operation for the paper bundle stacked on the subsequent bins.

Figure 35:
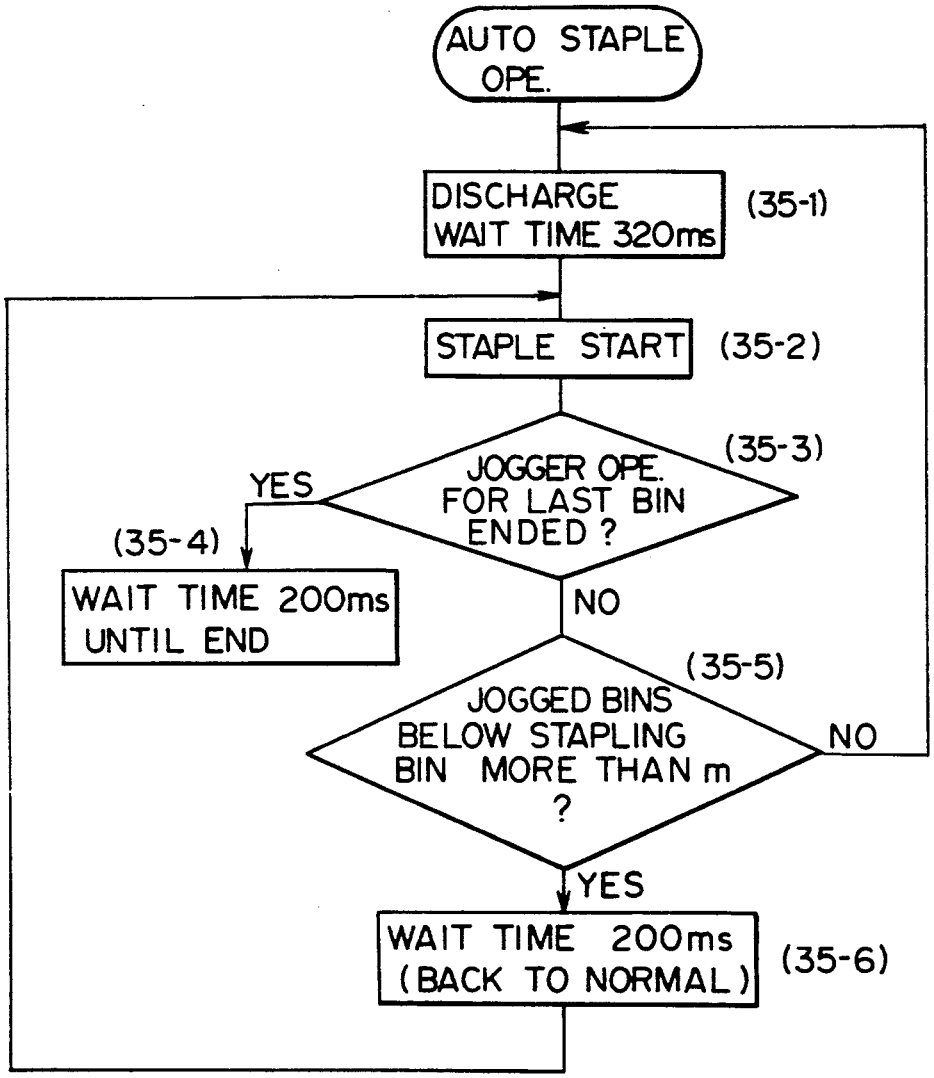
FIG. 35 is a flow chart of another embodiment of the auto staple mode in accordance with the present invention.

FIG. 35 illustrates a flow chart of another embodiment of auto staple mode operation.

In FIG. 35, the paper discharging wait time is arranged as 320 ms (step 35-1). If the number of bins which are located below the bin being stapled now and already jogged is more than m (i.e., N in steps 35-2 and 35-3 and Y in step 35-5), the wait time is rearranged as 200 ms (step 35-6).

On the other hand, if the already jogged bin number is less than m (i.e., N in step 35-5), the wait time is set as 320 ms (step 35-1). When the jogger operation for all bins are finished (i.e., Y in step 35-3), the wait time is set as 200 ms until the end of the operation (step 35-4).

As mentioned above, the already jogged bin number is always checked by comparing with the predetermined number m, so that when the jogged bin number becomes small, the paper discharging wait time is increased to promote the swinging motion.

Figure 36:
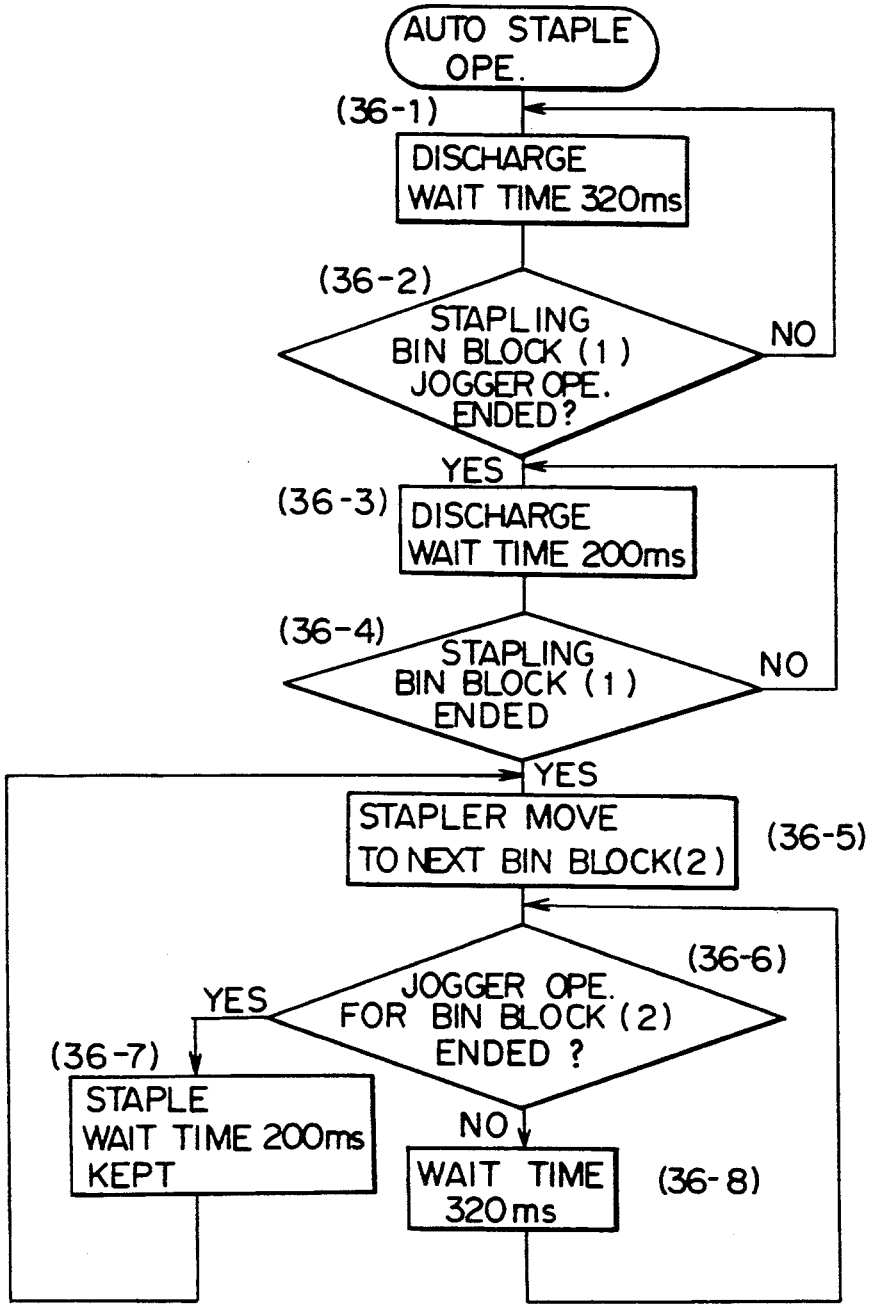
FIG. 36 is a flow chart of still another embodiment of the auto staple mode in accordance with the present invention.

FIG. 36 illustrates a flow chart of still another embodiment of the auto staple mode operation in which all of the bins are considered to be a plurality of blocks. The paper discharging wait time is set as 320 ms (step 36-1). At the time when the jogger operation is ended for one bin block (i.e., Y in step 36-2), the wait time is rearranged as the normal mode of 200 ms (step 36-3). When the jogger comes to the next bin block, the wait time is set back to 320 ms (i.e., Y in step 36-4 and N in steps 36-5 and 36-6). When the jogger operation is ended in this next bin block (i.e., Y in step 36-6), the stapling operation is conducted in the state where the wait time is maintained as 200 ms (step 36-7).

It is to be noted that in the manual staple operation or when the sort operation is ended in the auto staple operation, it becomes unnecessary to operate the jogger in accordance with the paper discharging motion, which makes it possible to delete the dummy time so that the productivity of the system is further enhanced.

Many widely different embodiments of the present invention may be constructed without departing from the spirit and scope of the present invention. It should be understood that the present invention is not limited to the specific embodiments described in the specification, except as defined in the appended claims.

What is claimed is:

1. An after treatment device comprising:

a sorting means for sorting papers into a plurality of bins;

a jogger means for jogging the papers sorted in each of the bins so as to arrange edges of the papers;

a stapling means for stapling the jogged papers in each of the bins; and a control means for selectively operating the stapling means at one of a special timing and a normal timing on the basis of a progressing condition of a jogging operation of the jogger means, when an auto staple mode is commanded, wherein the normal timing corresponds to an operating time period of the stapling means in a normal mode, and the special timing corresponds to an operating time period of the stapling means to which a dummy time period is added so as to lengthen the operating time period of the stapling means.

2. An after treatment device according to claim 1, which further comprises a detecting means for detecting the number of bins the jogging operation of which is finished, and the control means operates the stapling means at the normal timing in a case where the number of bins detected by the detecting means is not less than a predetermined number.

3. An after treatment device according to claim 2, wherein the control means operates the stapling means at the special timing in a case where the number of bins detected by the detecting means is less than a predetermined number.

4. An after treatment device according to claim 1, wherein all bins are divided into several blocks, and the control means operates the stapling means at the normal timing in a case where the jogging operation of a block at which the stapling operation is performed is finished.

5. An after treatment device according to claim 4, wherein the control means operates the stapling means at the special timing in a case where the jogging operation of a next block is not finished when the stapling means moves to the next block.

6. An after treatment device according to claim 4, wherein the control means operates the stapling means at the normal timing in a case where the jogging operation of a next block is finished when the stapling means moves to the next block.

7. An after treatment device comprising:

a sorting means for sorting papers into a plurality of bins;

a jogger means for jogging the papers sorted in each of the bins so as to arrange edges of the papers;

a stapling means for advancing on each of the bins, chucking the jogged papers in each of the bins retreating from each of the bins while chucking the jogged papers, stapling the chucked papers and discharging the stapled papers into each of the bins as a bundle of papers; and a control means for selectively operating the stapling means at one of a special timing and a normal timing on the basis of a progressing condition of a jogging operation of the jogger means, when an auto staple mode is commanded, wherein the normal timing corresponds to an operating time period of the stapling means in a normal mode, and the special timing corresponds to an operating time period of the stapling means to which a dummy time period is added so as to lengthen the operating time period of the stapling means;

the jogger means jogging the sorted papers during a time period after a chucking motion of the stapling means until a discharging motion of the stapling means; and the dummy time period is added to the time period after a chucking motion of the stapling means until a discharging motion of the stapling means.

8. An after treatment device according to claim 7, wherein the dummy time is added to a waiting time period of the stapling means during which the stapled papers are discharged into each of the bins.

9. An after treatment device according to claim 7, wherein the dummy time is obtained by decelerating a retreating motion of the stapling means after chucking the papers.

10. An after treatment device according to claim 7, wherein the dummy time is obtained by setting a waiting time period at least one of before a retreating motion of the stapling means after chucking the papers and after a retreating motion of the stapling means after chucking the papers.

11. An after treatment device according to claim 7, wherein the dummy time is obtained by setting waiting time periods respectively before and after a retreating motion of the stapling means after chucking the papers.

12. An after treatment device according to claim 7, wherein the dummy time is obtained by decelerating a moving speed of the stapling means.

13. An after treatment device according to claim 7, wherein the dummy time is obtained by setting a waiting time period at least one of before a stapling motion of the stapling means and after a stapling motion of the stapling means.

14. An after treatment device according to claim 7, wherein the dummy time is obtained by setting waiting time periods respectively before and after a stapling motion of the stapling means.

15. An after treatment device comprising:

a sorting means for sorting papers into a plurality of bins;

a jogger means for jogging the papers sorted in each of the bins so as to arrange edges of the papers;

a stapling means for stapling the jogged papers in each of the bins; and a control means for operating the stapling means at a special timing during which the stapling operation of the stapling means is performed simultaneously with the jogging operation of the jogger means, and for operating the stapling means at a normal timing after the jogging operation of all bins has been finished, when an auto stapling mode is commanded, wherein the normal timing corresponds to an operating time period of the stapling means in a normal mode, and the special timing corresponds to an operating time period of the stapling means to which a dummy time period is added so as to lengthen the operating time period of the stapling means.

* * * * *